US008390917B1

(12) United States Patent
Maeda et al.

(10) Patent No.: US 8,390,917 B1
(45) Date of Patent: Mar. 5, 2013

(54) MULTIPLE LINE SINGLE-PASS IMAGING USING SPATIAL LIGHT MODULATOR AND ANAMORPHIC PROJECTION OPTICS

(75) Inventors: Patrick Y. Maeda, Mountain View, CA (US); Timothy David Stowe, Alameda, CA (US); Philipp H. Schmaelzle, Los Altos, CA (US); Eric Peeters, Mountain View, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 0 days.

(21) Appl. No.: 13/217,038

(22) Filed: Aug. 24, 2011

(51) Int. Cl.
*G02B 26/00* (2006.01)
*G02B 26/08* (2006.01)

(52) U.S. Cl. ..... 359/290; 359/298

(58) Field of Classification Search ..... 359/290–292, 359/298, 316, 237, 239, 277, 201.1, 201.2, 359/223.1, 212.1, 212.2, 207.1, 619, 621; 353/122, 11, 13, 17, 19, 33; 348/201, 203, 348/550, E3.009, E5.139; 345/84, 87; 349/57, 349/113
See application file for complete search history.

(56) References Cited

U.S. PATENT DOCUMENTS 3,800,699 A 4/1974 Carley
5,754,217 A 5/1998 Allen
5,953,152 A 9/1999 Hewlett
5,954,424 A 9/1999 Anderson et al.
6,121,984 A 9/2000 Anderson
6,567,217 B1 5/2003 Kowarz et al.
6,606,739 B2 8/2003 Kanatake et al.
7,048,388 B2 5/2006 Takaura et al.
7,218,380 B2 5/2007 De Jager
7,508,570 B1 3/2009 Meisburger
8,031,390 B2 * 10/2011 Grasser et al. ..... 359/290
8,104,901 B2 * 1/2012 Kwon ..... 353/84
8,282,221 B2 10/2012 Arai et al.
2008/0062390 A1 3/2008 Zhang et al.
2010/0208329 A1 8/2010 Sandstrom et al.

* cited by examiner

*Primary Examiner* — Tuyen Tra
(74) *Attorney, Agent, or Firm* — Bever, Hoffman & Harms, LLP; Patrick T. Bever

(57) ABSTRACT

Two substantially one-dimensional scan line images are simultaneously generated by modulating a two-dimensional homogenous light field using a spatial light modulator having light modulating elements arranged in a plurality of rows and a plurality of columns. An upper group of modulating elements are configured using a first scan line image data group, and a lower group of modulating elements are configured using a second scan line image data group. The homogenous light source is then pulsed (toggled) to direct the two-dimensional homogenous light field onto the spatial light modulator. The resulting two-dimensional modulated light field is directed through an anamorphic optical system, which images and concentrates the modulated light on an imaging surface such that two parallel one-dimensional scan line images are simultaneously formed on the imaging surface.

19 Claims, 13 Drawing Sheets

MULTIPLE LINE SINGLE-PASS IMAGING USING SPATIAL LIGHT MODULATOR AND ANAMORPHIC PROJECTION OPTICS

FIELD OF THE INVENTION

This invention relates to imaging systems, and in particular to single-pass imaging systems that utilize high energy light sources for high speed image transfer operations.

BACKGROUND OF THE INVENTION

Laser imaging systems are extensively used to generate images in applications such as xerographic printing, mask and maskless lithographic patterning, laser texturing of surfaces, and laser cutting machines. Laser printers often use a raster optical scanner (ROS) that sweeps a laser perpendicular to a process direction by utilizing a polygon or galvo scanner, whereas for cutting applications lasers imaging systems use flatbed x-y vector scanning.

One of the limitations of the laser ROS approach is that there are design tradeoffs between image resolution and the lateral extent of the scan line. These tradeoffs arising from optical performance limitations at the extremes of the scan line such as image field curvature. In practice, it is extremely difficult to achieve 1200 dpi resolution across a 20" imaging swath with single galvanometers or polygon scanners. Furthermore, a single laser head motorized x-y flatbed architecture, ideal for large area coverage, is too slow for most high speed printing processes.

For this reason, monolithic light emitting diode (LED) arrays of up to 20" in width have an imaging advantage for large width xerography. Unfortunately, present LED array are only capable of offering 10 milliWatt power levels per pixel and are therefore only useful for some non-thermal imaging applications such as xerography. In addition, LED bars have differential aging and performance spread. If a single LED fails it requires the entire LED bar be replaced. Many other imaging or marking applications require much higher power. For example, laser texturing, or cutting applications can require power levels in the 10 W-100 W range. Thus LED bars cannot be used for these high power applications. Also, is difficult to extend LEDs to higher speeds or resolutions above 1200 dpi without using two or more rows of staggered heads.

Higher power semiconductor laser arrays in the range of 100 mW-100 Watts do exist. Most often they exist in a 1D array format such as on a laser diode bar often about 1 cm in total width. Another type of high power directed light source are 2D surface emitting VCSEL arrays. However, neither of these high power laser technologies allow for the laser pitch between nearest neighbors to be compatible with 600 dpi or higher imaging resolution. In addition, neither of these technologies allow for the individual high speed control each laser. Thus high power applications such as high power overhead projection imaging systems, often use a high power source such as a laser in combination with a spatial light modulator such as a DLP™ chip from Texas Instruments or liquid crystal arrays.

Prior art has shown that if imaging systems are arrayed side by side, they can be used to form projected images that overlap wherein the overlap can form a larger image using software to stitch together the image patterns into a seamless pattern. This has been shown in many maskless lithography systems such as those for PC board manufacturing as well as for display systems. In the past such arrayed imaging systems for high resolution applications have been arranged in such a way that they must use either two rows of imaging subsystems or use a double pass scanning configuration in order to stitch together a continuous high resolution image. This is because of physical hardware constraints on the dimensions of the optical subsystems. The double imaging row configuration can still be seamlessly stitched to her using a conveyor to move the substrate in single direction but such a system requires a large amount of overhead hardware real estate and precision alignment between each imaging row.

For the maskless lithography application, the time between exposure and development of photoresist to be imaged is not critical and therefore the imaging of the photoresist along a single line does not need be exposed at once. However, sometimes the time between exposure and development is critical. For example, xerographic laser printing is based on imaging photoreceptor by erasing charge which naturally decays over time. Thus the time between exposure and development is not time invariant. In such situations, it is desirable for the exposure system to expose a single line, or a few tightly spaced adjacent lines of high resolution of a surface at once.

In addition to xerographic printing applications, there are other marking systems where the time between exposure and development are critical. One example is the laser based variable data lithographic marking approach originally disclosed by Carley in U.S. Pat. No. 3,800,699 entitled, "FOUNTAIN SOLUTION IMAGE APPARATUS FOR ELECTRONIC LITHOGRAPHY". In standard offset lithographic printing, a static imaging plate is created that has hydrophobic imaging and hydrophilic non-imaging regions. A thin layer of water based dampening solution selectively wets the plate and forms an oleophobic layer which selectively rejects oil-based inks. In variable data lithographic marking disclosed in U.S. Pat. No. 3,800,699, a laser can be used to pattern ablate the fountain solution to form variable imaging regions on the fly. For such a system, a thin layer of dampening solution also decays in thickness over time, due to natural partial pressure evaporation into the surrounding air. Thus it is also advantageous to form a single continuous high power laser imaging line pattern formed in a single imaging pass step so that the liquid dampening film thickness is the same thickness everywhere at the image forming laser ablation step. However, for most arrayed high power high resolution imaging systems, the hardware and packaging surrounding a spatial light modulator usually prevent a seamless continuous line pattern to be imaged. Furthermore, for many areas of laser imaging such as texturing, lithography, computer to plate making, large area die cutting, or thermal based printing or other novel printing applications, what is needed is laser based imaging approach with high total optical power well above the level of 1 Watt that is scalable across large process widths in excess of 20" as well as having achievable resolution greater than 1200 dpi and allows high resolution high speed imaging in a single pass.

SUMMARY OF THE INVENTION

The present invention is directed to a high speed imaging method in which two or more substantially one-dimensional scan line image portions of a two-dimensional image are simultaneously generated on an imaging surface. The imaging method is described using an imaging system including a homogenous light source, a spatial light modulator, and an anamorphic optical system to generate the scan line image portions on the imaging surface. The two-dimensional image generated by the imaging system during the imaging process is stored using known techniques in an image data file made up of multiple scan line image data groups, each scan line image data group including a row of image pixel data portions that collectively form an associated substantially one-dimensional scan line image portion of the two-dimensional image. The spatial light modulator includes an array of light modulating elements that are arranged in a plurality of rows and a plurality of columns. During a first phase of the imaging operation, the spatial light modulator is configured using at least two scan line image data groups, where each scan line image data group is used to configure the light modulating elements disposed in an assigned two-dimensional horizontal region of the spatial light modulator (i.e., all light modulating elements disposed in a contiguous group of rows of the array). For example, a first scan line image data group is used to configure the modulating elements of a first modulating element group including rows disposed in the upper half of the array, and a second scan line image data group is used configure the modulating elements of a second modulating element group including rows disposed in the lower half of the array. In accordance with an aspect of the present invention, multiple modulating elements disposed in each column of each modulating element group are adjusted in accordance with an associated image pixel data portion of the associated scan line image data group. After the modulating elements are configured, homogenous light is directed onto the spatial light modulator such that the configured modulating elements generate a two-dimensional modulated light field. That is, depending on the modulated state of each configured modulating element, the homogenous light is either passed into the modulated light field or prevented from passing into the modulated light field, thus producing a two-dimensional "field" of light and dark regions corresponding to the modulation pattern of the spatial lights modulator. The modulated light field is then transmitted through the anamorphic optical system, which is formed and arranged to anamorphically image and concentrate the modulated light field to generate two or more substantially one-dimensional scan line images extending in the process direction on the imaging surface. That is, because the modulated light field is generated by the spatial light modulator, whose modulating elements are configured according to two or more scan line image data groups, the modulated light field includes a "stretched" image of two or more one-dimensional scan line images. By utilizing the anamorphic optical system to concentrate the modulated light field, high total optical intensity (flux density) (i.e., on the order of hundreds of Watts/cm$^2$) can be generated on any point of the two or more scan line images without requiring a high intensity light source, thereby facilitating a reliable vet high speed imaging system that can be used, for example, to simultaneously produce multiple one-dimensional scan line images in a single-pass high resolution high speed printing application.

According to an embodiment of the present invention, the homogenous light generator includes one or more light sources and a light homogenizer optical system for homogenizing light beams generated by the light sources. For high power homogenous light applications, the light source is preferably composed of multiple lower power light sources whose light emissions are mixed together by the homogenizer optics and produce the desired high power homogenous output. According to alternative embodiments of the present invention, the light source of the homogenous light generator includes multiple low power light generating elements arranged in a row or two-dimensional array. An additional benefit of using several independent light sources is that laser speckle due to coherent interference is reduced.

The spatial light modulator utilized in the imaging operation includes a control circuit having memory cells that store image data for individually controlling the modulated state of each of light modulating elements. Depending on the data stored in its associated memory cell, which is determined by the associated image pixel data portion that is assigned to a given light modulating structure, each modulating element is adjustable between an "on" (first) modulated state and an "off" (second) modulated state in accordance with the predetermined image data. Each light modulating structure disposed to either pass or impede/redirect the associated portions of the homogenous light according to its modulated state. When one of the modulating elements is in the "on" modulated state, the modulating structure directs its associated modulated light portion in a corresponding predetermined direction (e.g., the element passes or reflects the associated light portion toward the anamorphic optical system). Conversely, when the modulating element is in the "off" modulated state, the associated received light portion is prevented from passing to the anamorphic optical system (e.g., the light modulating structure absorbs/blocks the associated light portion, reflects the associated light portion away from the anamorphic optical system). By modulating homogenous light in this manner prior to being anamorphically projected and concentrated, the present invention is able to produce a high power scan (process) line along the entire imaging region simultaneously, as compared with a rastering system that only applies high power to one point of the scan line at any given instant. In addition, because the relatively low power homogenous light is spread over the large number of modulating elements, the present invention can be produced using low-cost, commercially available spatial light modulating devices, such as digital micromirror (DMD) devices, electro-optic diffractive modulator arrays, or arrays of thermo-optic absorber elements.

According to an aspect of the present invention, the spatial light modulator and the anamorphic optical system are arranged such that modulated light received from each column of light modulating elements combine to form two or more associated image pixel regions ("pixels") of the two or more substantially one-dimensional scan line images. That is, the concentrated modulated light portions received from two or more light modulating elements in a given column (and in the "on" modulated state) are imaged onto the imaging surface by the anamorphic optical system, whereby the received light portions substantially overlap but are slightly offset in a vertical direction such that adjacent light portions collectively form corresponding image pixel regions of the two or more scan line images. A key aspect of the present invention lies in understanding that the light portions passed by each light modulating element represent one sub-pixel of binary data that is delivered to the scan line by the anamorphic optical system, so that the brightness of each imaging "pixel" making up the two or more scan line images is controlled by the number of elements in the associated group/column that are in the "on" state. Accordingly, by individually controlling the multiple modulating elements disposed in each group and column, and by concentrating the light passed by each group/column onto a corresponding imaging pixel region, the present invention provides an imaging system having gray-scale capabilities using constant (non-modulated) homogenous light. According to an embodiment of the present invention, the overall anamorphic optical system includes a cross-process optical subsystem and a process-direction optical subsystem that image and concentrate the modulated light portions received from the spatial light modulator such that the imaged and concentrated modulated light forms the substantially one-dimensional scan line image, wherein the concentrated modulated light at the scan line image has a higher optical intensity (i.e., a higher flux density) than that of the homogenized light. By anamorphically concentrating (focusing) the two-dimensional modulated light pattern to form a high energy elongated scan line, the imaging system of the present invention outputs a higher intensity scan line. The scan line image formed may have different pairs of cylindrical or acylindrical lens that address the converging and tight focusing of the scan line image along the process direction and the projection and magnification of the scan line image along the cross-process direction. In one specific embodiment, the cross-process optical subsystem includes first and second cylindrical or acylindrical lenses arranged to project and magnify the modulated light onto the elongated scan line in a cross-process direction, and the process-direction optical subsystem includes a third cylindrical or acylindrical focusing lens arranged to concentrate and demagnify the modulated light on the scan line in a direction parallel to a process direction. It should be understood that the overall optical system may have several more elements to help compensate for optical aberrations or distortions and that optical elements may be transmissive lenses or reflective mirror lenses with multiple folding of the beam path.

According to an aspect of the present invention, the homogenous light source is pulsed or strobed (toggled on and off) in coordination with movement of the imaging surface such that each successive pair of scan line images is generated in a corresponding portion of the imaging surface in order to avoid double-exposure (smearing) of the successive scan line images while producing the two-dimensional image. For example, during a first time period of the imaging operation, the homogenous light source deactivated (turned off) while the spatial light modulator is configured in accordance with first pair of scan line image data groups. The homogenous light source is then activated (turned on) during a subsequent (second) time period of the imaging operation, whereby the configured modulating elements of the spatial light modulator generate a first pair of scan line images on a first elongated imaging region on the imaging surface. During a next (third) time period of the imaging operation, the homogenous light source is again deactivated (turned off) while the spatial light modulator is configured in accordance with second pair of scan line image data groups and the imaging surface is moved a predetermined incremental amount in the cross-process direction, which in one embodiment is equal to the cross-process "height" of the first pair of scan line images. The homogenous light source is then re-activated during a subsequent (fourth) time period of the imaging operation, whereby a second pair of scan line images are generated on a second elongated imaging region of the imaging surface, preferably such that the two pairs form a substantially contiguous image feature. This process is repeated using each successive pair of scan line image data groups until the entire two-dimensional image is generated on the imaging surface.

According to a specific embodiment of the present invention, the spatial light modulator comprises a DLP™ chip from Texas Instruments, referred to as a Digital Light Processor in the packaged form. The semiconductor chip itself is often referred to as a Digital Micromirror Device or DMD. This DMD includes an two dimensional array of microelectromechanical (MEMs) mirror mechanisms disposed on a substrate, where each MEMs mirror mechanism includes a mirror that is movably supported between first and second tilted positions according to associated control signals generated by a control circuit. The spatial light modulator and the anamorphic optical system are positioned in a folded arrangement such that, when each mirror is in the first tilted position, the mirror reflects its associated received light portion toward the anamorphic optical system, and when the mirror is in the second tilted position, the mirror reflects the associated received light portion away from the anamorphic optical system towards a beam dump. An optional heat sink is fixedly positioned relative to the spatial light modulator receive light portions from mirrors disposed in the second tilted position towards the beam dump. An optional frame is utilized to maintain each of the components in fixed relative position. An advantage of a reflective DMD-based imaging system is that the folded optical path arrangement facilitates a compact system footprint.

According to another specific embodiment of the present invention, homogeneous light from a light source directed onto a DMD-type spatial light modulator is strobed (pulsed) to correspond with the rotation of an imaging drum cylinder, where a damping (fountain) solution is coated onto the outer (imaging) surface of the drum cylinder, and the concentrated modulated light from the anamorphic optical system is used to selectively evaporate the damping solution prior to passing under a toner supply structure. The DMD-type spatial light modulator is configured according to a first pair of modulating element groups during a first time period while the light source is de-activated, and then the light source is activated (pulsed) during a subsequent (second) time period to generate the two or more scan line images in a first elongated scanning region of the outer drum surface. The light source is then dc-activated, and the MEMs mirror mechanisms are reconfigured according to a second pair of modulating element groups as the drum rotates a predetermined amount during a subsequent (third) time period. The light source is then re-activated such that third and fourth substantially one-dimensional scan line images are generated on a second elongated imaging region of said imaging surface in a predetermined registration with the first pair of scan line images. In one specific embodiment, the light modulating elements utilized to generate each scan line image are disposed in contiguous groups of rows, and strobing is timed to correspond with a rotation amount of the drum roller equal to the distance between the two rows, whereby the two-dimensional image is formed by generating two contiguous scan line images during each imaging phase. In another embodiment, the light modulating elements utilized to generate each scan line image are disposed in separated groups of rows, and pulsing/strobing of the light source is timed to correspond with a rotation amount of the drum roller equal to the height of the two rows, whereby the two-dimensional image is formed by generating two interlaced scan line images during each imaging phase.

BRIEF DESCRIPTION OF THE DRAWINGS

These and other features, aspects and advantages of the present invention will become better understood with regard to the following description, appended claims, and accompanying drawings, where:

DETAILED DESCRIPTION OF THE DRAWINGS

The present invention relates to improvements in imaging systems and related apparatus (e.g., scanners and printers). The following description is presented to enable one of ordinary skill in the art to make and use the invention as provided in the context of a particular application and its requirements. As used herein, directional terms such as "upper", "uppermost", "lower", and "front", are intended to provide relative positions for purposes of description, and are not intended to designate an absolute frame of reference. In addition, the phrases "integrally connected" and "integrally attached" are used herein to describe the connective relationship between two portions of a single molded or machined structure, and are distinguished from the terms "connected" or "coupled" (without the modifier "integrally"), which indicates two separate structures that are joined by way of, for example, adhesive, fastener, clip, or movable joint. Various modifications to the preferred embodiment will be apparent to those with skill in the art, and the general principles defined herein may be applied to other embodiments. Therefore, the present invention is not intended to be limited to the particular embodiments shown and described, but is to be accorded the widest scope consistent with the principles and novel features herein disclosed.

Figure 1:
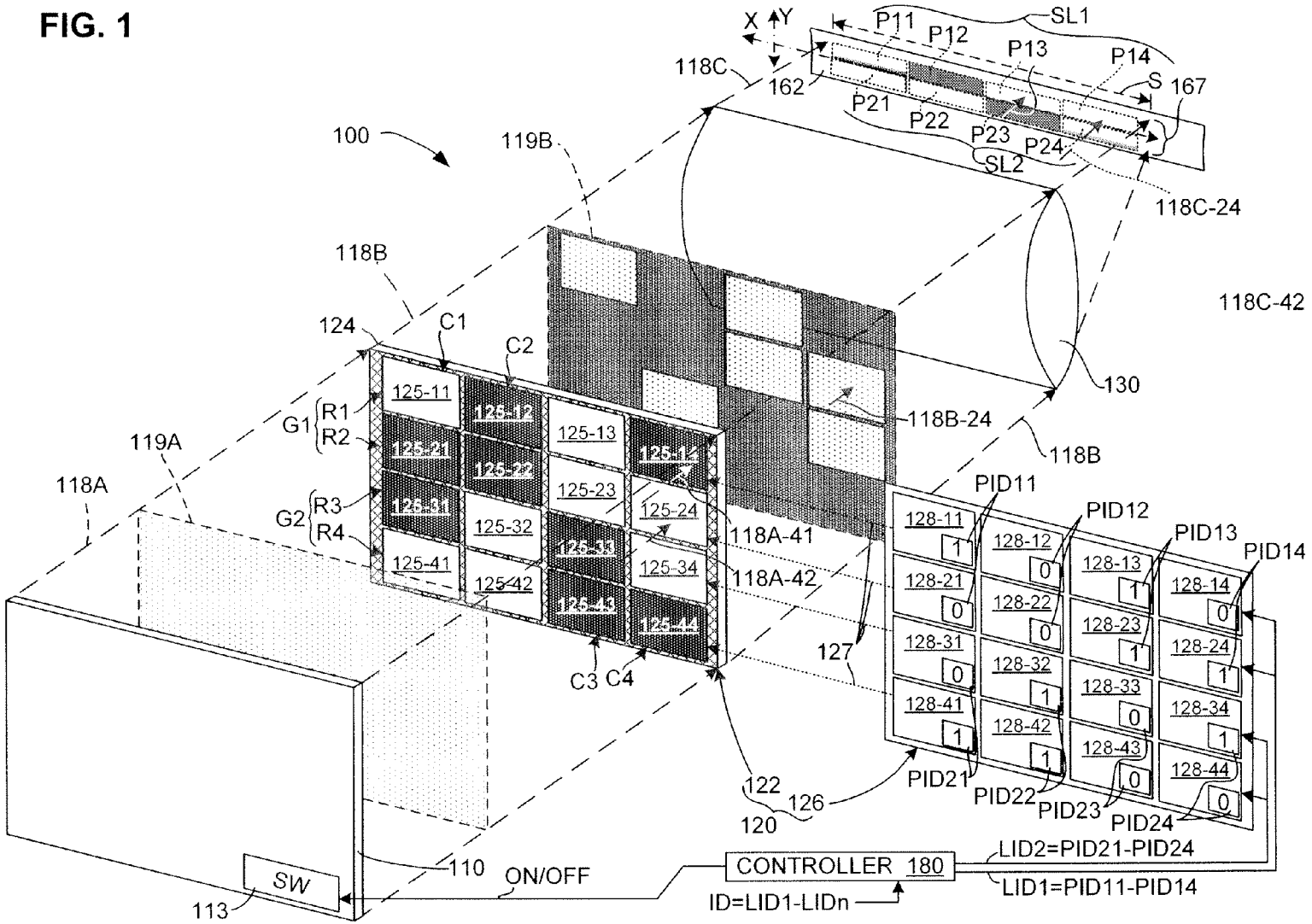
FIG. 1 is a top side perspective view showing a generalized imaging system utilized in accordance with an exemplary embodiment of the present invention.

FIG. 1 is a perspective view showing a simplified single-pass imaging system 100 utilized to simultaneously generate two or more substantially one-dimensional scan line image portions of a two-dimensional image on an imaging surface 162 in accordance with a simplified embodiment of the present invention. Simplified imaging system 100 generally includes a homogenous light generator 110 and a spatial light modulator 120 that are controlled to function as described below by a controller 180, and an anamorphic optical system 130 that is used to simultaneously generate scan line image portions SL1 and SL2 on imaging surface 162. The imaging method described herein uses imaging system 100 to process digital image data stored using known techniques in an image data file ID, which is depicted at the bottom of FIG. 1 being transmitted to controller 180 in the manner described below.

Consistent with most standardized image file formats, image data file ID is made up of scan line image data groups LID1 to LIDn, where each scan line image data group includes multiple image pixel data portions that collectively form an associated one-dimensional scan line image portion of the two-dimensional image. For example, in the simplified example shown in FIG. 1, scan line image data group LID1 includes four image pixel data portions PID11 to PID14, and scan line image data group LID2 includes image pixel data portions PID21 to PID24. Each image pixel data portion (e.g., image pixel data portion PID11) includes one or more bits of image data corresponding to the color and/or gray-scale properties of the corresponding image pixel associated with the corresponding portion of the two-dimensional image. Those skilled in the art will recognize that, in practical embodiments, each scan line image data group typically includes a much larger number of image pixel data portions that the four-pixel or eight-pixel image rows described herein.

Referring to the lower left portion of FIG. 1, homogenous light generator 110 serves to generate continuous (i.e., constant/non-modulated) homogenous light 118A that forms a substantially uniform two-dimensional homogenous light field 119A. In accordance with an aspect of the present invention, homogenous light generator 110 is controllable (e.g., by way of an "on/off" control signal transmitted to a control switch 113) to toggle between an active "on" state during which homogenous light 118A is generated, and a deactivated "off" state in which light is not generated. While homogenous light generator 110 is in the activated "on" state, homogenous light field 119A, which is depicted by the projected dotted rectangular box (i.e., homogenous light field 119A does not form a structure), is made up of homogenous light 118A having substantially the same constant energy level (i.e., substantially the same flux density).

Figure 2A:
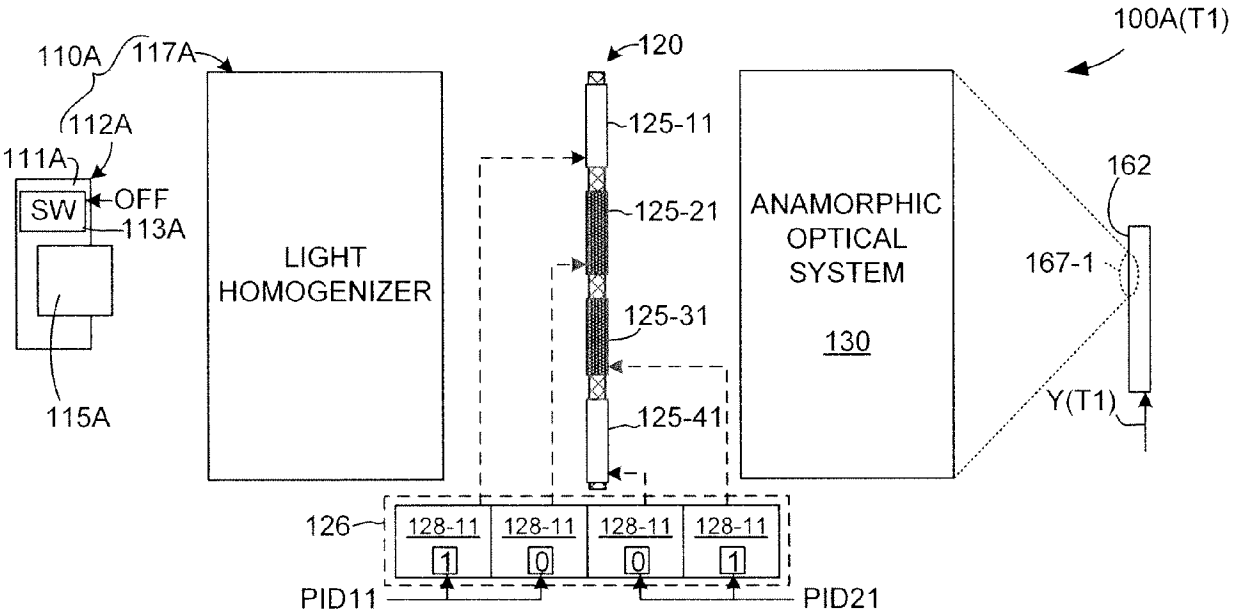
FIGS. 2(A), 2(B), 2(C) and 2(D) are simplified side views showing the imaging system of FIG. 1 during an imaging operation according to an embodiment of the present invention.
Figure 2B:
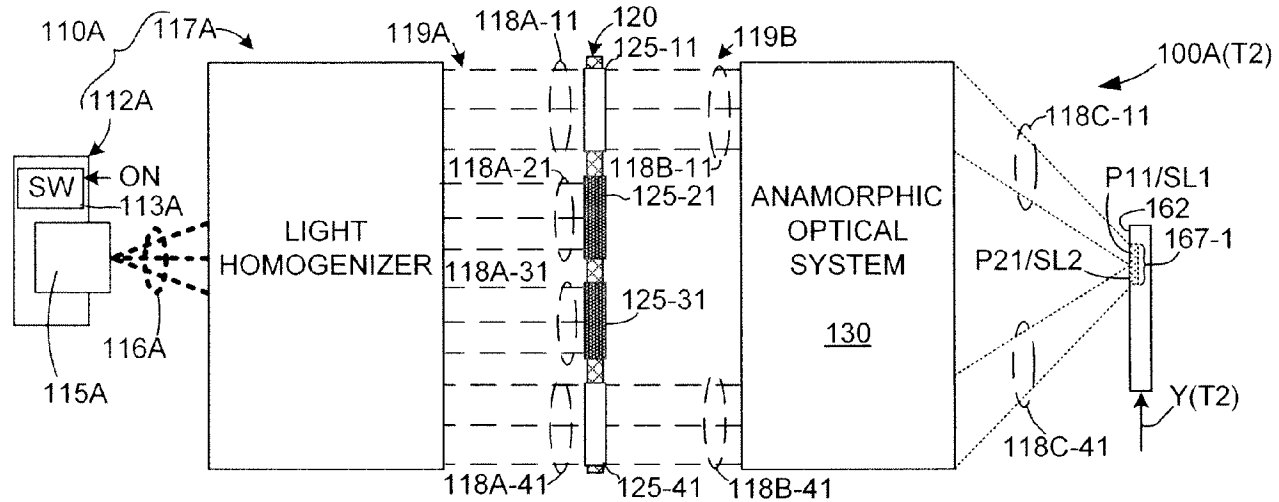

FIGS. 2(A) and 2(B) are simplified side views showing an imaging system 100A including a homogeneous light generator 110A according to an embodiment of the present invention. Referring to FIG. 2(A), homogenous light generator 110A includes a light source 112A including a light generating element (e.g., one or more lasers or light emitting diode) 115A fabricated or otherwise disposed on a suitable carrier (e.g., a semiconductor substrate) 111A, and a light homogenizing optical system (homogenizer) 117A. Light source 112A is controlled (toggled) by way of a switch (SW) 113A that is responsive to a control signal (ON/OFF) between a de-activated state in which no light is generated (i.e., as indicated in FIG. 2(A)), and an activated state (shown in FIG. 2(B)) in which light beams 116A are generated and directed onto homogenizer 117A. Homogenizer 117A then generates homogenous light 118A by homogenizing (i.e., mixing and spreading out light beam 116A over an extended two-dimensional area) as well as reducing any divergences of light beams 116. When activated as indicated in FIG. 2(B), those skilled in the art will recognize that this arrangement effectively coverts the concentrated, relatively high energy intensity high divergence of light beam 116A into dispersed, relatively low energy flux homogenous light 118A that is substantially evenly distributed onto all modulating elements (e.g., modulating elements 125-11, 125-21, 125-31 and 125-41) of spatial light modulator 120. Note that light homogenizer 117A can be implemented using any of several different technologies and methods known in the art including but not limited to the use of a fast axis concentrator (FAC) lens together with microlens arrays for beam reshaping, or additionally a light pipe approach which causes light mixing within a waveguide.

Figure 3A:
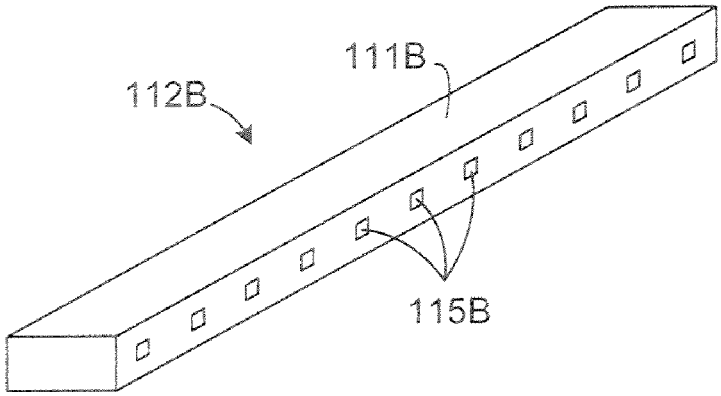
FIGS. 3(A) and 3(B) are simplified perspective views showing alternative light sources utilized by the homogenous light generator of the imaging system of FIG. 1 according to alternative embodiments of the present invention.
Figure 3B:
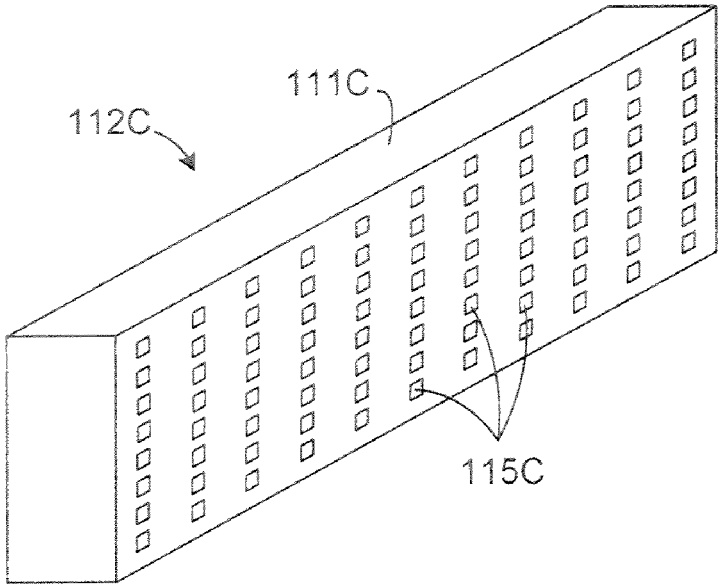

FIGS. 3(A) and 3(B) illustrate alternative light sources that may be utilized by homogeneous light source 110 of FIG. 1. FIG. 3(A) shows a light source 112B according to a specific embodiment in which multiple edge emitting laser diodes 115B are arranged along a straight line that is disposed parallel to the rows of light modulating elements (not shown). In alternative specific embodiments, light source 112B consists of an edge emitting laser diode bar or multiple diode bars stacked together. These sources no not need to be single mode and could consist of many multimode lasers. Optionally, a fast-axis collimation (FAC) microlens could be used to help collimate the output light from an edge emitting laser. FIG. 3(B) illustrates a light source 112C according to another specific embodiment in which multiple vertical cavity surface emitting lasers (VCSELs) 115C are arranged in a two-dimensional array on a carrier 111C. This two-dimensional array of VCSELS could be stacked in any arrangement such as hexagonal closed packed configurations to maximize the amount of power per unit area. Ideally such laser sources would have high plug efficiencies (e.g., greater than 50%) so that passive water cooling or forced flow could be used to easily take away excess heat.

Referring back to the left center left portion of FIG. 1, spatial light modulator 120 is disposed in homogenous light field 119A, and includes a modulating element array 122 and a control circuit 126. Spatial light modulator 120 serves the purpose of modulating portions of homogenous light 118A in accordance with the method described below, whereby spatial light modulator 120 converts homogenous light field 119A into a modulated light field 119B that is projected through anamorphic optical system 130 onto an elongated imaging region 167 of imaging surface 162. In a practical embodiment such a spatial light modulator can be purchased commercially and would typically have two-dimensional (2D) array sizes of 1024×768 (SVGA resolution) or higher resolution with light modulation element (pixel) spacing on the order 5-20 microns. For purposes of illustration, only a small subset of light modulation elements is depicted in FIG. 1.

Referring to the left-center region of FIG. 1, modulating element array 122 of spatial light modulator 120 includes modulating elements 125-11 to 125-44 that are disposed in four rows R1-R4 and four columns C1-C4 on a support structure 124. Modulating elements 125-11 to 125-44 are disposed in homogenous light field 119A such that a light modulating structure (e.g., a mirror, a diffractive element, or a thermo-optic absorber element) of each modulating element receives a corresponding portion of homogenous light 118A (e.g., modulating elements 125-14 and 125-24 respectively receive homogenous light portions 118A-14 and 118A-14), and is positioned to selectively pass or redirect the received corresponding modulated light portion along a predetermined direction toward anamorphic optical system 130 (e.g., modulating element 125-24 allows received light portion 118A-24 to pass to anamorphic optical system 130, but modulating element 125-14 blocks/redirects/prevents received light portion 118A-14 from passing to anamorphic optical system 130).

Referring to the lower right region of FIG. 1, control circuit 126 includes an array of memory cell 128-11 to 128-44 for storing a portion of image data ID that is transmitted (written) to control circuit 126 from an external source (not shown) using known techniques. In the exemplary embodiment, each memory cell 128-11 to 128-44 stores a single data bit (1 or 0), and each light modulating element 125-11 to 125-44 is respectively individually controllable by way of the data bit stored in its associated memory cell 128-11 to 128-44 (e.g., by way of control signals 127) to switch between an "on" (first) modulated state and an "off" (second) modulated state. When the associated memory cell of a given modulating element stores a logic "1" value, the given modulating element is controlled to enter an "on" modulated state, whereby the modulating element is actuated to direct the given modulating element's associated received light portion toward anamorphic optic 130. For example, in the simplified example, modulating element 125-24 is turned "on" (e.g., rendered transparent) in response to the logic "1" stored in memory cell 128-24, whereby received light portion 118A-24 is passed through spatial light modulator 120 and is directed toward anamorphic optic 130. Conversely, modulating element 125-14 is turned "off" (e.g., rendered opaque) in response to the logic "0" stored in memory cell 128-14, whereby received light portion 118A-24 is blocked (prevented from passing to anamorphic optic 130). By selectively turning "on" or "off" modulating elements 125-11 to 125-44 in accordance with image data ID in the manner described herein, spatial light modulator 120 serves to modulate (i.e., pass or not pass) portions of continuous homogenous light 118A such that the modulated light is directed onto anamorphic optical system 130. As set forth in additional detail below, spatial light modulator 120 is implemented using any of several technologies, and is therefore not limited to the linear "pass through" arrangement depicted in FIG. 1.

As used herein, the portions of homogenous light 118A (e.g., homogenous light portion 118A-24) that are passed through or otherwise directed from spatial light modulator 120 toward anamorphic optic 130 are individually referred to as modulated light portions, and collectively referred to as modulated light 118B or two-dimensional modulated light field 119B. For example, after passing through light modulating element 125-24, which is turned "on", homogenous light portion 118A-24 becomes modulated light portion 118B-24, which is passed to anamorphic optic system 130 along with light portions passed through light modulating elements 125-11, 125-41, 125-32, 125-42, 125-13, 125-23 and 125-34, as indicated by the light colored areas of the diagram depicting modulated light field 119B. Conversely, when a given modulating element (e.g., modulating element 125-14) is in the "off" modulated state, the modulating element is actuated to prevent (e.g., block or redirect) the given modulating element's associated received light portion (e.g., light portion 118A-14) from reaching anamorphic optic system 130, whereby the corresponding regions of the diagram depicting modulated light field 119B are dark.

Referring to the center right portion of FIG. 1, anamorphic optical system 130 serves to anamorphically image and concentrate (focus) two-dimensional modulated light field 119B onto elongated imaging region 167 of imaging surface 162. In particular, anamorphic optical system 130 includes one or more optical elements (e.g., lenses or mirrors) that are positioned to receive the two-dimensional pattern of modulated light field 119B, where the one or more opt elements (e.g., lenses or mirrors) are arranged to concentrate the received light portions to a greater degree along the cross-process (e.g., Y-axis) direction than along the process (X-axis) direction, whereby the received light portions are anamorphically focused to form elongated scan line images SL1 and SL2 that extends parallel to the process/scan (X-axis) direction. Note that modulated light portions that have passed through anamorphic optical system 130 but have not yet reached imaging surface 162 are referred to as concentrated modulated light portions (e.g., modulated light portion 118B-24 becomes concentrated modulated light portion 118C-24 between anamorphic optical system 130 and imaging surface 162. Anamorphic system 130 is represented for the purposes of simplification in FIG. 1 by a single generalized anamorphic projection lens. In practice anamorphic system 130 is typically composed of multiple separate cylindrical or acylindrical lenses such as described below with reference to FIGS. 4(A) and 4(B), but is not limited to the generalized lens or specific lens systems described herein.

Figure 4A:
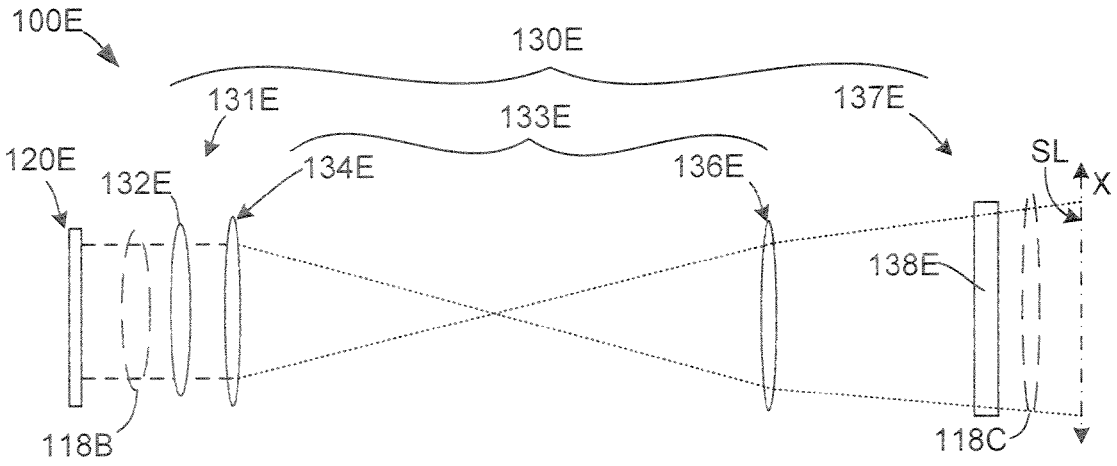
FIGS. 4(A) and 4(B) are simplified top and side views, respectively, showing a multi-lens anamorphic optical system utilized by imaging system of FIG. 1 according to specific embodiment of the present invention.
Figure 4B:
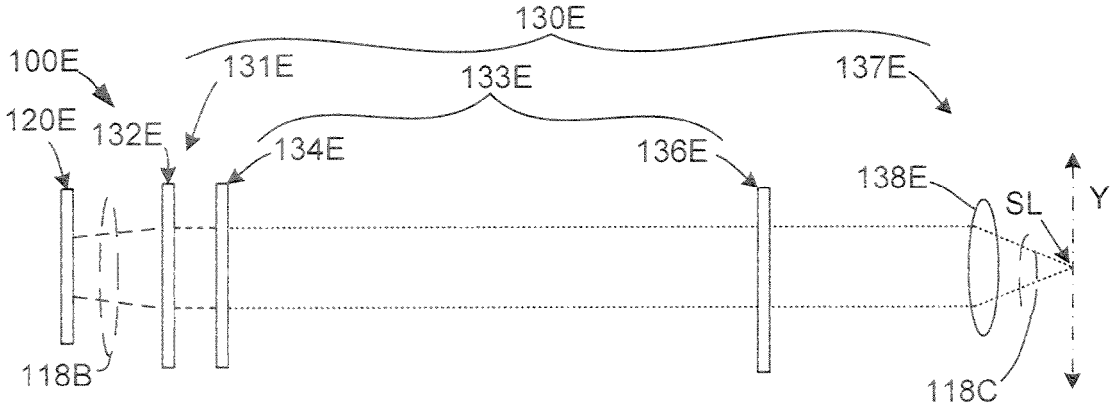

FIGS. 4(A) and 4(B) are simplified diagrams showing a portion of an imaging system 100E including a generalized anamorphic optical system 130E according to an exemplary embodiment of the present invention. Referring to FIG. 4(A), anamorphic optical system 130E includes an optional collimating optical subsystem 131E, a cross-process optical subsystem 133E, and process-direction optical subsystem 137E according to an exemplary specific embodiment of the present invention. As indicated by the ray traces in FIGS. 4(A) and 4(B), optical subsystems 131E, 133E and 137E are disposed in the optical path between spatial light modulator 120E and scan line SL, which is generated at the output of imaging system 100E. FIG. 4(A) is a top view indicating that collimating optical subsystem 131E and cross-process optical subsystem 133E act on the modulated light portions 118B passed by spatial light modulator 120E to form concentrated light portions 118C on scan line SL parallel to the X-axis (i.e., in the cross-process direction), and FIG. 4(B) is a side view that indicates how collimating optical subsystem 131E and process-direction optical subsystem 137E act on modulated light portions 118B passed by spatial light modulator 120E and generate concentrated light portions 118C on scan line SL in a direction perpendicular to the Y-axis (i.e., in the process direction). Optional collimating optical subsystem 131E includes a collimating field lens 132E formed in accordance with known techniques that is located immediately after spatial light modulator 120E, and arranged to collimate the light portions that are slightly diverging off of the surface of the spatial light modulator 120E. Cross-process optical subsystem 133E is a two-lens cylindrical or acylindrical projection system that magnifies light in the cross-process (scan) direction (i.e., along the X-axis), and process-direction optical subsystem 137E is a cylindrical or acylindrical single focusing lens subsystem that focuses light in the process (cross-scan) direction (i.e., along the Y-axis). The advantage of this arrangement is that it allows the intensity of the light (e.g., laser) power to be concentrated on scan line SL located at the output of single-pass imaging system 100E. Two-lens cylindrical or acylindrical projection system 133E includes a first cylindrical or acylindrical lens 134E and a second cylindrical or acylindrical lens 136E that are arranged to project and magnify modulated light portions (imaging data) 118B passed by spatial light modulator 120E (and optional collimating optical subsystem 131E) onto an imaging surface (e.g., a cylinder) in the cross process direction. Lens subsystem 137E includes a third cylindrical or acylindrical lens 138E that concentrates the projected imaging data down to a narrow high resolution line image on scan line SL. As the focusing power of lens 138E is increased, the intensity of the light on spatial light modulator 120E is reduced relative to the intensity of the line image generated at scan line SL. However, this means that cylindrical or acylindrical lens 138E must be placed closer to the process surface (e.g., an imaging drum) with a clear aperture extending to the very edges of lens 138E. Additional details regarding anamorphic optical system 130E are described in co-owned and co-pending application Ser. No. 13/216,976, entitled ANAMORPHIC PROJECTION OPTICAL SYSTEM FOR HIGH SPEED LITHOGRAPHIC DATA IMAGING, which is incorporated herein by reference in its entirety.

Referring again to FIG. 1, according to another aspect of the present invention, spatial light modulator 120 and anamorphic optical system 130 are arranged such that modulated light portions received from each column of light modulating elements of array 122 form an imaging "spot" that is ideally equal dimensioned in both directions or slightly elongated in the cross-process (Y-axis) direction. The spot is an image of the corresponding column of elements on the modulator surface. When imaging surface 162 is placed precisely at the process (X-axis) direction focal line defined by anamorphic optical system 130, the modulated light portions received from all light modulating elements in each column form a "spot" that is ideally equal dimensioned or slightly elongated in the cross-process (Y-axis) direction. By modulating the portions of this elongated "spot" such that the upper portion of the spot (e.g., pixel image portion P21) is generated in response to image data from a first scan line image data group (e.g., pixel image data PID11 of scan line image group LID1), and such that the lower portion of the spot (e.g., pixel image portion P21) is generated in response to image data from a second scan line image data group (e.g., pixel image data PID21 of scan line image group LID2), the upper and lower "spot" portions combine to form two an image pixel region ("pixel"), and these image pixel regions collectively form two substantially one-dimensional scan line images SL1 and SL2. Note that each associated pair of pixel image portions (e.g., portions P11 and P12) are shown as separate regions for descriptive purposes, but that in practice these regions can overlap. A key aspect of the present invention lies in understanding that the light portions passed by each light modulating element represent one sub-pixel of binary data that is delivered to the scan line by the anamorphic optical system, so that the brightness of each imaging "pixel" making up the two or more scan line images is controlled by the number of elements in the associated group/column that are in the "on" state. Accordingly, by individually controlling the multiple modulating elements disposed in each group and column, and by concentrating the light passed by each group/column onto a corresponding imaging pixel region, the present invention provides an imaging system having gray-scale capabilities using constant (non-modulated) homogenous light, where these gray-scale capabilities are used to generate two or more scan line images.

Referring again to FIG. 1, according to an aspect of the present invention, imaging system 100 simultaneously generates at least two scan line image portions (e.g., scan line image portions SL1 and SL2) on imaging surface 162 by simultaneously configuring spatial light modulator 120 using at least two of the "n" scan line image data groups LID1 to LIDn of image data file ID. In the exemplary embodiment, this aspect is achieved by writing two scan line image data groups (e.g., LID1 and LID2) of image data file ID into spatial light modulator 120 during each imaging phase such that light modulating elements 125-11 to 125-44 are simultaneously configured in accordance with both of the scan line image data groups. In addition, each of the two or more scan line image data groups are written into a corresponding group of rows of modulating elements array 122 in the exemplary embodiment, as indicated at the left side of array 122 in FIG. 1, upper rows R1 and R2 form a first scan line image group G1, and lower rows R3 and R4 form a second scan line image group G2. Finally, each pixel data portion is utilized to achieve gray scale imaging by configuring (controlling the on/off states of selected modulating elements in each column of array 122. For example, as indicated in the lower portion of FIG. 1, in the exemplary embodiment two scan line image data groups LID1 and LID2 are written from controller 180 into control circuit 126 of spatial light modulator 120, which in turn writes corresponding control bits "1" and "0" into control cells 128-11 to 128-44. Specifically, image pixel data portion PID11 of scan line image data group LID1 is written from controller 180 into control circuit 126, which in turn writes a logic "1" into control cell 128-11 and a logic "0" into control cell 128-21 (note that both control cell 128-11 and control cell 128-21 are in column C1). Remaining image pixel data portions PID12, PID13 and PID14 of scan line image data group LID1 are written in a similar manner into the remaining control cells associated with rows R1 and R2 of array 122, with pixel image data portion PID12 written as a logic "0" into control cells 128-12 and 128-22, pixel image data portion PID13 written as a logic "1" into control 128-13 and 128-23, and pixel image data portion PID14 written logic "0" into control cell 128-14 and logic "1" into control cell 128-24. Scan line image data group LID2 is similarly written into control cells of control circuit 126 that are associated with rows R3 and R4 of array 122, with image pixel data portion PID21 written as a logic "0" into control cell 128-31 and a logic "1" into control cell 128-41, pixel image data portion PID22 written as a logic "1" into control cells 128-32 and 128-42, pixel image data portion PID23 written as a logic "0" into control cells 128-33 and 128-43, and pixel image data portion PID24 written as logic "1" into control cell 128-34 and logic "0" into control cell 128-44. Note that these values are entirely arbitrarily selected for purposes of this example.

According to another aspect of the present invention, each pixel data portion is utilized to achieve gray scale imaging by configuring (controlling the on/off states of) a corresponding pair of modulating elements in an associated column/group of array 122. That is, the brightness (or darkness) of each image pixel region P11 to P14 and P21 to P24 is controlled by the number of light modulating elements that are turned "on" in its associated column/group of array 122. For example, image pixel regions P12 and P23 include "black" spots because all of light modulating elements associated with these regions (i.e., modulating elements 125-11 and 125-22 in column C2, and modulating elements 125-33 and 125-43 in column C3 are turned "off". In contrast, light modulating elements 125-32 and 125-42 in column C2, and elements 125-13 and 23 in column C2 are turned "on", whereby image pixel portions P22 and P13 have a maximum brightness ("white") spot. The two outer columns are controlled to illustrate gray scale imaging, where modulating elements 125-21 and 125-31 turned "off" and modulating elements 125-11 and 125-41 turned "on" in column C1, thereby forming image pixel regions P11 and P21 as gray-scale spots where the darkest region is disposed along the interface between the two regions. Conversely, modulating elements 125-14 and 125-44 are turned "off" and modulating elements 125-24 and 125-34 are turned "on" in column C4, thereby forming image pixel regions P14 and P24 as gray-scale spots where the lightest region is disposed along the interface between the two regions. Note that the simplified spatial light modulator 120 shown in FIG. 1 includes only four modulating elements in each column for descriptive purposes, and those skilled in the art will recognize that increasing the number of modulating elements disposed in each column of array 122 would enhance gray scale control by facilitating the production of spots exhibiting additional shades of gray. In one preferred embodiment at least 24 pixels are used in one column to adjust grayscale, thus allowing for single power adjustments in scan line segments of at close to 4%). Additional detail regarding a presently preferred method for gray scale control in imaging system 100 is described in co-owned and co-pending application Ser. No. 13/252,943, entitled MULTI-LEVEL IMAGING USING SPATIAL LIGHT MODULATOR AND ANAMORPHIC PROJECTION OPTICS, which is incorporated herein by reference in its entirety. A large number of modulating elements in each column of array 122 also facilitates one or more "reserve" or "redundant" elements that are only activated when one or more of the regularly used elements malfunctions, thereby extending the operating life of the imaging system or allowing for corrections to optical line distortions such as bow (also known as line smile).

Those skilled in the art will understand that the production of a two-dimensional image using the method described above requires moving (i.e., scrolling) imaging surface 162 in a cross-process (Y-axis) direction after each imaging operation, which in turn requires reconfiguring spatial light modulator 120 after each imaging operation. According to an aspect of the present invention, homogenous light source 110 is pulsed or strobed (toggled on and off) in coordination with movement of imaging surface 162 in the cross-process (Y-axis) direction and reconfiguration of spatial light modulator 120 such that each successive pairs of scan line images are generated on imaging surface 162 in a way that avoids double-exposure (smearing) of the scan line images that collectively produce the two-dimensional image. An exemplary imaging operation illustrating this process is described below with reference to FIGS. 2(A) to 2(D).

FIG. 2(A) illustrates imaging system 100A(T1) (i.e., imaging system 100A during a first time period T1 of the imaging operation) when homogenous light source 110A is deactivated (turned off) in response to an "off" command, and modulating element groups G1& G2 of spatial light modulator 120 are respectively configured in accordance with scan line image data groups LID1 and LID2, which occurs in the manner described above with reference to FIG. 1. In particular, FIG. 2(A) depicts the configuration of modulating elements 125-11 and 125-21 using pixel image data portion PID11 and the configuration of modulating elements 125-31 and 125-41 using pixel image data portion PID21. At this point imaging surface 162 is positioned in the cross-process direction at an arbitrarily selected position Y(T1).

FIG. 2(B) illustrates imaging system 100A(T2) (i.e., imaging system 100A during a subsequent time period T2) during which homogenous light source 110A is activated (turned on), whereby homogenous light field 119A is directed onto spatial light modulator 120. Because of the configured state of light modulating elements 125-11, 125-21, 125-31 and 125-41, homogeneous light portions 118A-11 and 118A-41 are passed through spatial light modulator 120, but homogeneous light portions 118A-21 and 118A-31 are blocked, whereby modulated light portions 118B-11 and 118B-41 form modulated light field 119B that is imaged and concentrated by anamorphic optical system 130, and concentrated modulated light portions 118C-11 and 118C-41 produce pixel image regions P11 and P12, which are part of a first pair of scan line images SL1 and SL2 formed in a first elongated imaging region 167-1 on imaging surface 162. The position of first elongated imaging region 167-1 on imaging surface 162 is determined by the position Y(T2) of imaging surface 162 in the cross-process direction at time T2. Note that position Y(T2) may be the same as position Y(T1), e.g., when imaging surface 162 is moved incrementally, or may represent a different position when imaging surface 162 is moved continuously.

Figure 2C:
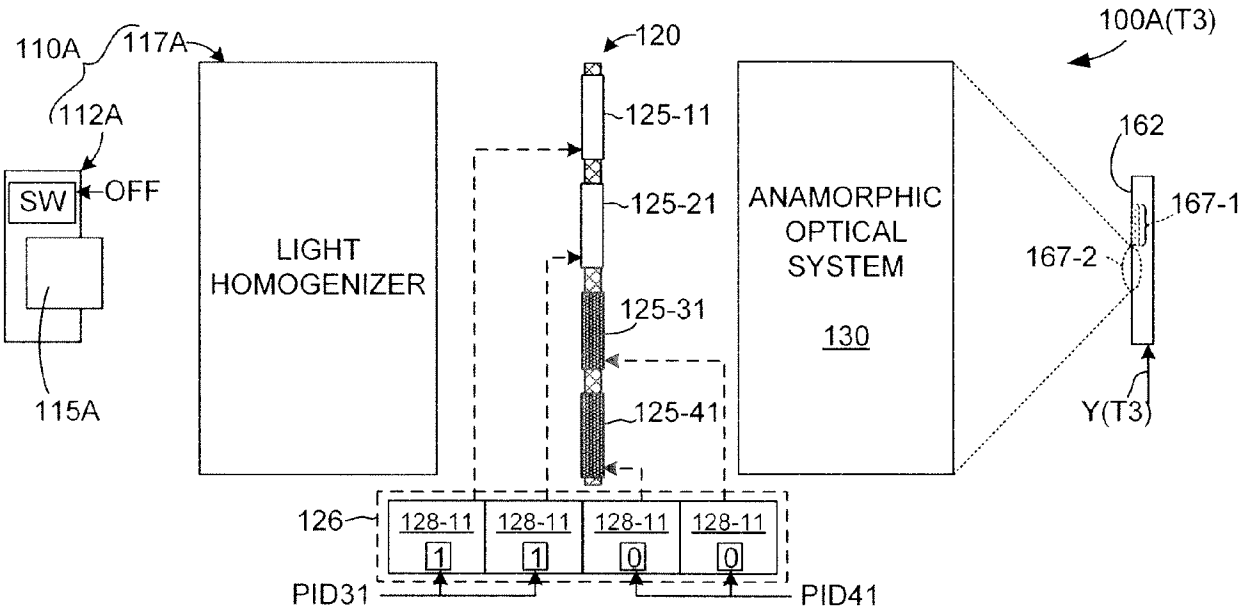

FIG. 2(C) illustrates imaging system 100A(T3) during next sequential (third) time period of the imaging operation after light generating element 115A of homogenous light source 110A is again deactivated and spatial light modulator 120 is reconfigured in accordance with a second pair of scan line image data groups LID3 and LID4 and imaging surface 162 is moved to a position Y(T3). Scan line image data groups LID3 and LID4 represent third and fourth scan line image data groups of image data file ID, and FIG. 2(C) depicts the reconfiguration of modulating elements 125-11 and 125-21 using pixel image data portion PID31 of scan line image data group LID3, and the configuration of modulating elements 125-31 and 125-41 using pixel image data portion PID41 of scan line image data group LID4.

Figure 2D:
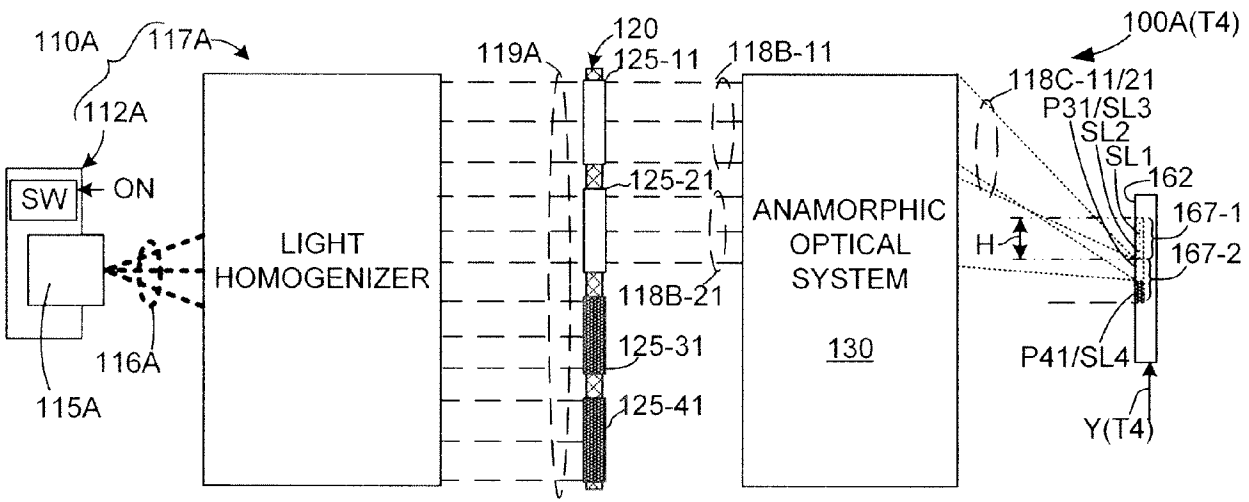

FIG. 2(D) illustrates imaging system 100H(T4) during which homogenous light source 110A is again re-activated (turned on), whereby homogenous light field 119A is directed onto spatial light modulator 120, and because light modulating elements 125-11, 125-21 are "on" and light modulating elements 125-31, 125-41 are "off" at time T4, modulated light portions 118B-51 and 118B-71 are passed from spatial light modulator 120 to anamorphic optical system 130. Under these conditions, concentrated light portions 118C-11 and 118C-21 form a "white" spot in pixel image region P31 of a scan line image SL3, and pixel image region P41 of a scan line image SL4 remains "dark", where scan line images SL3 and SL4 are formed in a second elongated imaging region 167-2 on imaging surface 162. The location of second elongated imaging region 167-2 is determined by the position Y(T4) of imaging surface 162 in the cross-process direction at time T4, and in the present embodiment the position of second elongated imaging region 167-2 is determined by moving imaging surface 162 in a cross-process (Y-axis) direction a distance equal to a total height H of scan lines SL1 and SL2 (i.e., the height of elongated imaging region 167-1 measured in the cross-scan direction).

According to alternative embodiments of the present invention, the spatial light modulator is implemented using commercially available devices including a digital micromirror device (DMD), such as a digital light processing (DLP®) chip available from Texas Instruments of Dallas Tex., USA, an electro-optic diffractive modulator array such as the Linear Array Liquid Crystal Modulator available from Boulder Nonlinear Systems of Lafayette, Colo., USA, or an array of thermo-optic absorber elements such as Vanadium dioxide reflective or absorbing mirror elements. Other spatial light modulator technologies may also be used. While any of a variety of spatial light modulators may be suitable for a particular application, many print/scanning applications today require a resolution 1200 dpi and above, with high image contrast ratios over 10:1, small pixel size, and high speed line addressing over 30 kHz. Based on these specifications, the currently preferred spatial light modulator is the DLP™ chip due to its best overall performance.

Figure 5:
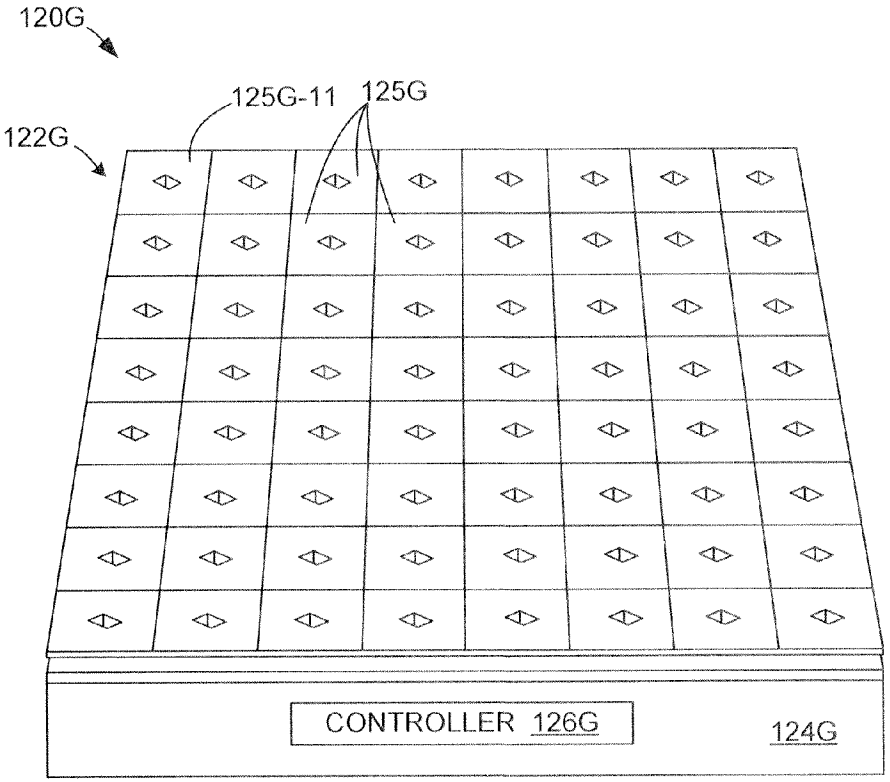
FIG. 5 (PRIOR ART)
FIG. 5 is a perspective view showing a portion of a DMD-type spatial light modulator utilized by imaging system of FIG. 1 according to a specific embodiment of the present invention.

FIG. 5 is a perspective view showing a portion of a DMD-type spatial light modulator 120G including a modulating element array 122G made up of multiple microelectromechanical (MEMs) mirror mechanisms 125G. DMD-type spatial light modulator 120G is utilized in accordance with a specific embodiment of the present invention. Modulating element array 122G is consistent with DMDs sold by Texas Instruments, wherein MEMs mirror mechanisms 125G are arranged in a rectangular array on a semiconductor substrate (i.e., "chip" or support structure) 124G. Mirror mechanism 125G are controlled as described below by a control circuit 126G that also is fabricated on substrate 124G according to known semiconductor processing techniques, and is disposed below mirrors 125G. Although only sixty-four mirror mechanisms 125G are shown in FIG. 5 for illustrative purposes, those skilled in the art will understand that any number of mirror mechanisms are disposed on DMD-type modulating element array 122G, and that DMDs sold by Texas Instruments typically include several hundred thousand mirrors per device.

Figure 6:
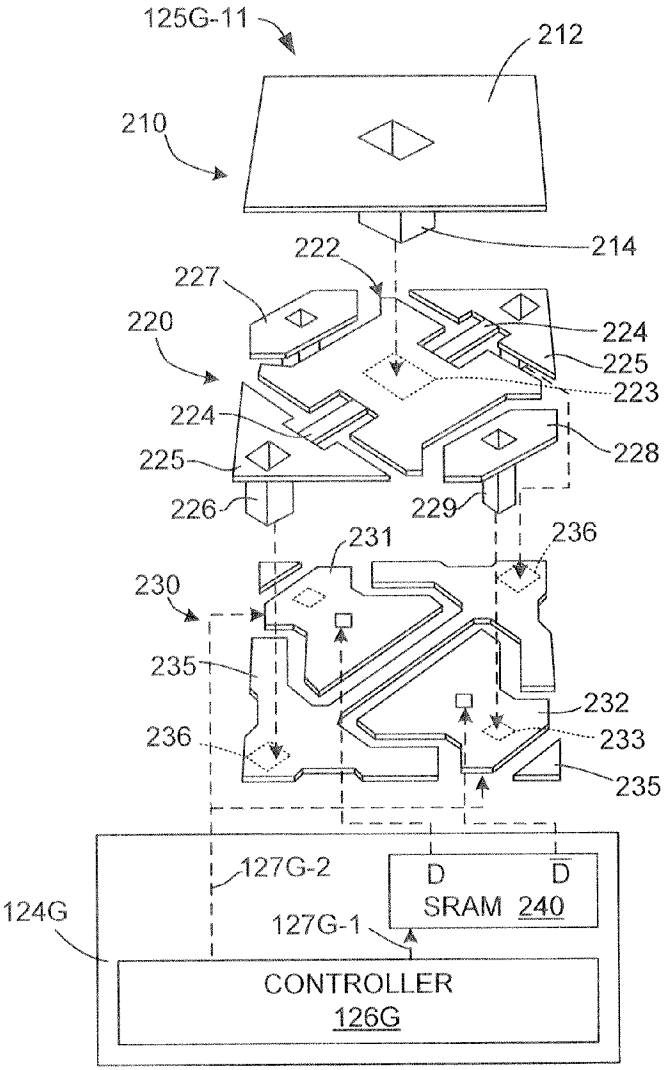
FIG. 6 (PRIOR ART)
FIG. 6 is an exploded perspective view showing a light modulating element of the DMD-type spatial light modulator of FIG. 5 in additional detail.

FIG. 6 is a combination exploded perspective view and simplified block diagram showing an exemplary mirror mechanism 125G-11 of DMD-type modulating element array 122G (see FIG. 5) in additional detail. For descriptive purposes, mirror mechanism 125G-11 is segmented into an uppermost layer 210, a central region 220, and a lower region 230, all of which being disposed on a passivation layer (not shown) formed on an upper surface of substrate 124G. Uppermost layer 210 of mirror mechanism 125G-11 includes a square or rectangular mirror (light modulating structure) 212 that is made out of aluminum and is typically approximately 16 micrometers across. Central region 220 includes a yoke 222 that connected by two compliant torsion hinges 224 to support plates 225, and a pair of raised electrodes 227 and 228. Lower region 230 includes first and second electrode plates 231 and 232, and a bias plate 235. In addition, mirror mechanism 125G-11 is controlled by an associated SRAM memory cell 240 (i.e., a bi-stable flip-flop) that is disposed on substrate 124G and controlled to store either of two data states by way of control signal 127G-1, which is generated by control circuit 126G in accordance with image data as described in additional detail below. Memory cell 240 generates complementary output signals D and D-bar that are generated from the current stored state according to known techniques.

Lower region 230 is formed by etching a plating layer or otherwise forming metal pads on a passivation layer (not shown) formed on an upper surface of substrate 124G over memory cell 240. Note that electrode plates 231 and 232 are respectively connected to receive either a bias control signal 127G-2 (which is selectively transmitted from control circuit 126G in accordance with the operating scheme set forth below) or complementary data signals D and D-bar stored by memory cell 240 by way of metal vias or other conductive structures that extend through the passivation layer.

Central region 220 is disposed over lower region 230 using MEMS technology, where yoke 222 is movably (pivotably) connected and supported by support plates 225 by way of compliant torsion hinges 224, which twist as described below to facilitate tilting of yoke 222 relative to substrate 124G. Support plates 225 are disposed above and electrically connected to bias plate 235 by way of support posts 226 (one shown) that are fixedly connected onto regions 236 of bias plate 235. Electrode plates 227 and 228 are similarly disposed above and electrically connected to electrode plates 231 and 232, respectively, by way of support posts 229 (one shown) that are fixedly connected onto regions 233 of electrode plates 231 and 232. Finally, mirror 212 is fixedly connected to yoke 222 by a mirror post 214 that is attached onto a central region 223 of yoke 222.

Figure 7C:
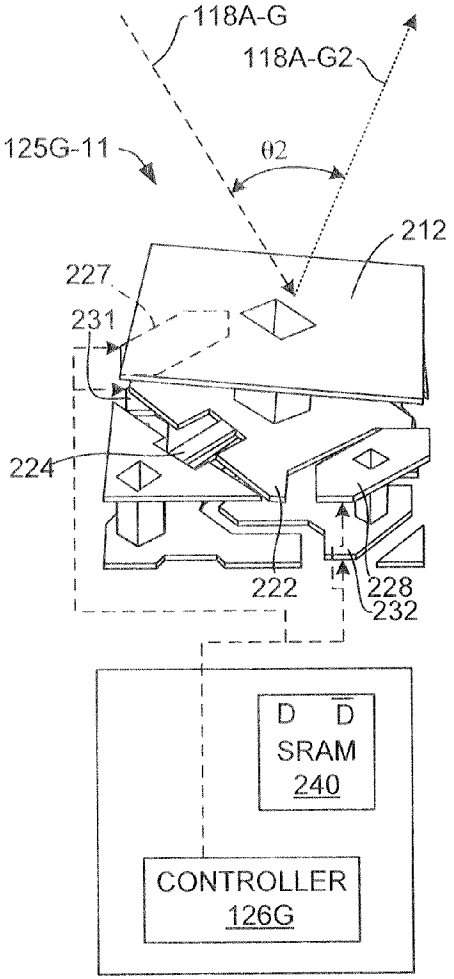
FIGS. 7(A), 7(B) and 7(C) are perspective views showing the light modulating element of FIG. 6 during operation.
Figure 7B:
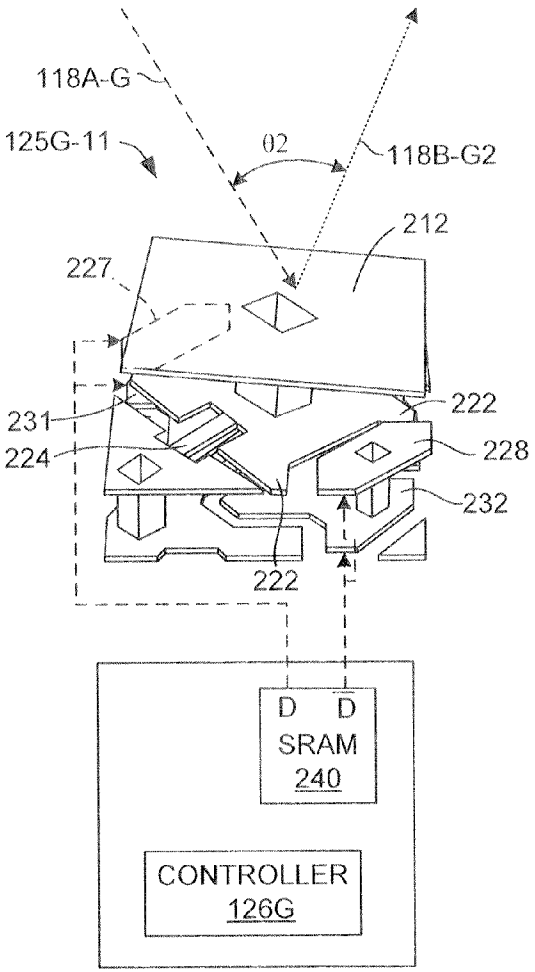
Figure 7A:
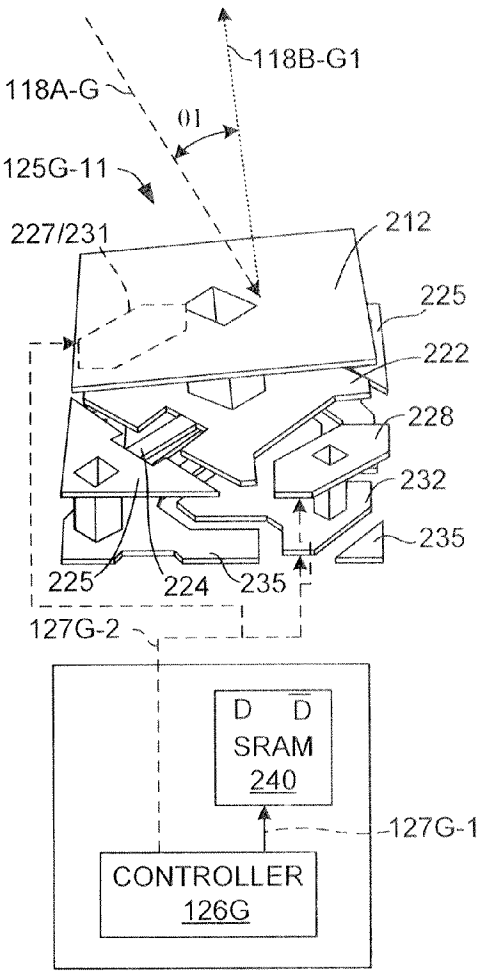

FIGS. 7(A) to 7(C) are perspective/block views showing mirror mechanism 125G-11 of FIG. 5 during operation. FIG. 7(A) shows mirror mechanism 125G-11 in a first (e.g., "on") modulating state in which received light portion 118A-G becomes reflected (modulated) light portion 118B-G1 that leaves mirror 212 at a first angle θ1. To set the "on" modulating state, SRAM memory cell 240 stores a previously written data value such that output signal D includes a high voltage (VDD) that is transmitted to electrode plate 231 and raised electrode 227, and output signal D-bar includes a low voltage (ground) that is transmitted to electrode plate 232 and raised electrode 228. These electrodes control the position of the mirror by electrostatic attraction. The electrode pair formed by electrode plates 231 and 232 is positioned to act on yoke 222, and the electrode pair formed by raised electrodes 227 and 228 is positioned to act on mirror 212. The majority of the time, equal bias charges are applied to both sides of yoke 222 simultaneously (e.g., as indicated in FIG. 7(A), bias control signal 127G-2 is applied to both electrode plates 227 and 228 and raised electrodes 231 and 232). Instead of flipping to a central position, one might expect, this equal bias actually holds mirror 122 in its current "on" position because the attraction force between mirror 122 and raised electrode 231/elect-ode plate 227 is greater (i.e., because that side is closer to the electrodes) than the attraction force between mirror 122 and raised electrode 232/electrode plate 228.

To move mirror 212 from the "on" position to the "off" position, the required image data bit is loaded into SRAM memory cell 240 by way of control signal (see the lower portion of FIG. 7(A). As indicated in FIG. 7(A), once all the SRAM cells of array 122G have been loaded with image data, the bias control signal is de-asserted, thereby transmitting the D signal from SRAM cell 240 to electrode plate 231 and raised electrode 227, and the D-bar from SRAM cell 240 to electrode plate 232 and raised electrode 228, thereby causing mirror 212 to move into the "off" position shown in FIG. 7(B), whereby received light portion 118A-G becomes reflected light portion 118B-G2 that leaves mirror 212 at a second angle θ2. In one embodiment, the flat upper surface of mirror 212 tilts (angularly moves) in the range of approximately 10 to 12° between the "on" state illustrated in FIG. 7(A) and the "off" state illustrated in FIG. 7(B). When bias control signal 127G-2 is subsequently restored, as indicated in FIG. 7(C), mirror 212 is maintained in the "off" position, and the next required movement can be loaded into memory cell 240. This bias system is used because it reduces the voltage levels required to address the mirrors such that they can be driven directly from the SRAM cells, and also because the bias voltage can be removed at the same time for the whole chip, so every mirror moves at the same instant.

As indicated in FIGS. 7(A) to 7(C), the rotation torsional axis of mirror mechanism 125G-11 causes mirrors 212 to rotate about a diagonal axis relative to the x-y coordinates of the DLP chip housing. This diagonal tilting requires that the incident light portions received from the spatial light modulator in an imaging system be projected onto each mirror mechanism 125G at a compound incident angle so that the exit angle of the light is perpendicular to the surface of the DIP clip. This requirement complicates the side by side placement of imaging systems.

Figure 8:
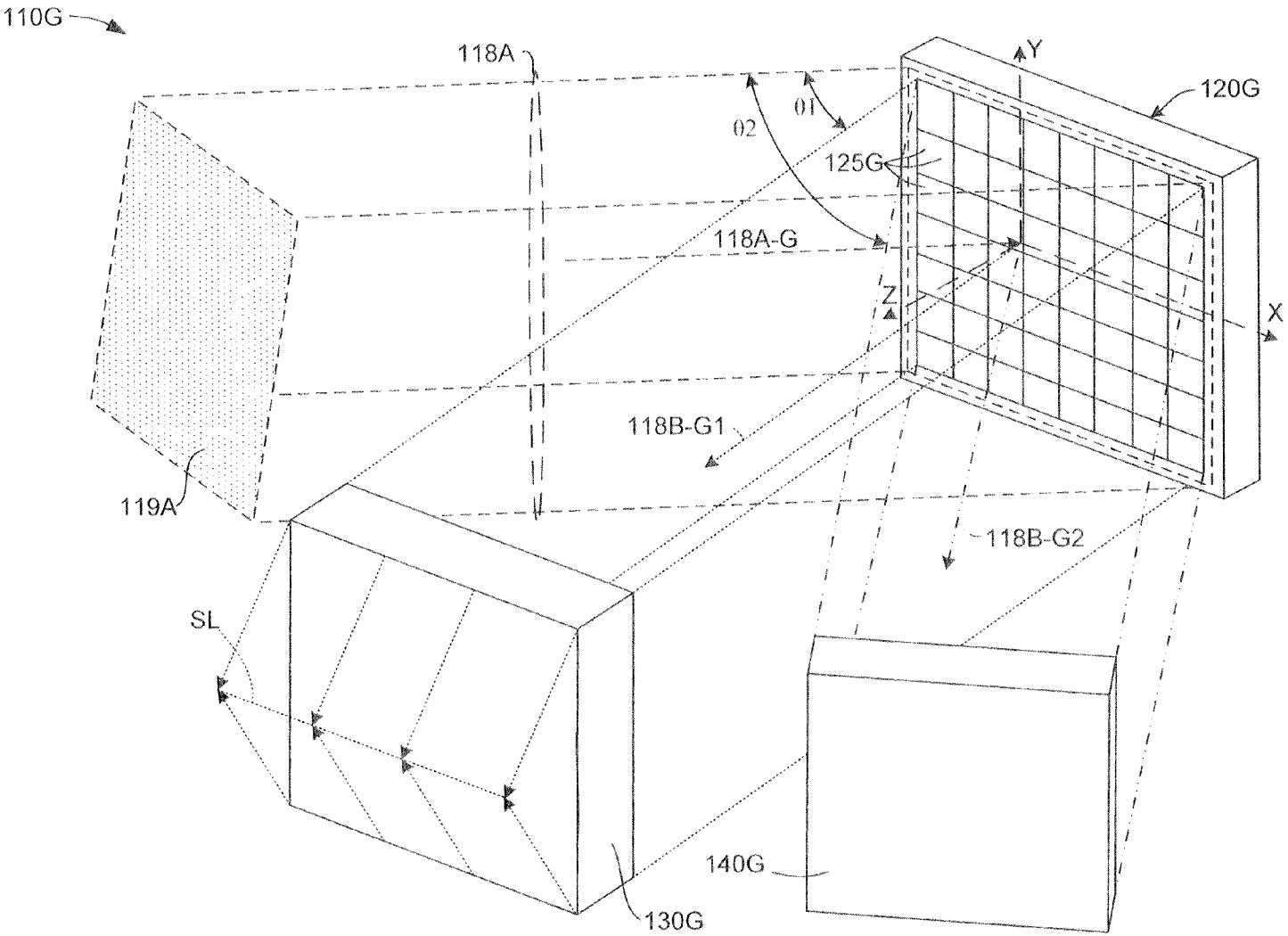
FIG. 8 is a simplified perspective view showing a imaging system utilizing the DMD-type spatial light modulator of FIG. 5 in a folded arrangement according to a specific embodiment of the present invention.

FIG. 8 is a simplified perspective view showing an imaging system 100G including DMD-type spatial light modulator 120G disposed in a preferred "folded" arrangement according to another embodiment of the present invention. Similar to the generalized system 100 discussed above with reference to FIG. 1, imaging system 100G includes a homogenous light generator 110G and an anamorphic optical system 130 that function and operate as described above. Imaging system 100G is distinguished from the generalized system in that spatial light modulator 120G is positioned relative to homogenous light generator 110G and anamorphic optical system 130 at a compound angle such that incident homogenous light portion 118A-G is neither parallel nor perpendicular to any of the orthogonal axes X, Y or Z defined by the surface of spatial light modulator 120G, and neither is reflected light portions 118B-G1 and 118B-G2 (respectively produced when the mirrors are in the "on" and positions) With the components of imaging system 100G positioned in this "folded" arrangement, portions of homogenous light 118A-G directed to spatial light modulator 120G from homogenous light generator 110G are reflected from MEMs mirror mechanism 125G to anamorphic optical system only when the mirrors of each MEMs mirror mechanism 125G is in the "on" position (e.g., as described above with reference to FIG. 7(A)). That is, as indicated in FIG. 8, each MEMs mirror mechanism 125G that is in the "on" position reflects an associated one of light portions 118E-G1 at angle θ1 relative to the incident light direction, whereby light portions 118B-G1 are directed by spatial light modulator 120G along corresponding predetermined directions to anamorphic optical system 130, which is positioned and arranged to focus portions 118G onto scan line SL, where scan line SL is perpendicular to the Z-axis defined by the surface of spatial light modulator 120G. The compound angle θ1 between the input rays 118A to the output "on" rays directed towards the anamorphic system 130G (e.g., ray 118B-G1) is typically 22-24 degrees or twice the mirror rotation angle of the DMD chip. Conversely, each MEMs mirror mechanism 125G that is in the "off" position reflects an associated one of light portions 118E-G2 at angle θ2, whereby light portions 18B-G2 are directed by spatial light modulator 120G away from anamorphic optical system 130. The compound angle between the entrance and "off" rays, θ2 is usually approximately 48 degrees. According to an aspect of the preferred "folded" arrangement, imaging system 100G includes a heat sink structure 140G that is positioned to receive light portions 118B-G2 that are reflected by MEMs mirror mechanisms 125G in the "off" position. According to another aspect of the preferred "folded" arrangement using the compound incident angle design set forth above, the components of imaging system 100G are arranged in a manner that facilitates the construction of a seamless assembly including any number of identical imaging systems 100G.

In one embodiment, the components of the system shown in FIG. 8 are maintained in the "folded" arrangement by way of a rigid frame that is described in detail in co-owned and co-pending application Ser. No. 13/216,817, entitled SINGLE-PASS IMAGING SYSTEM USING SPATIAL LIGHT MODULATOR AND ANAMORPHIC PROJECTION OPTICS, which is incorporated herein by reference in its entirety.

Figure 9:
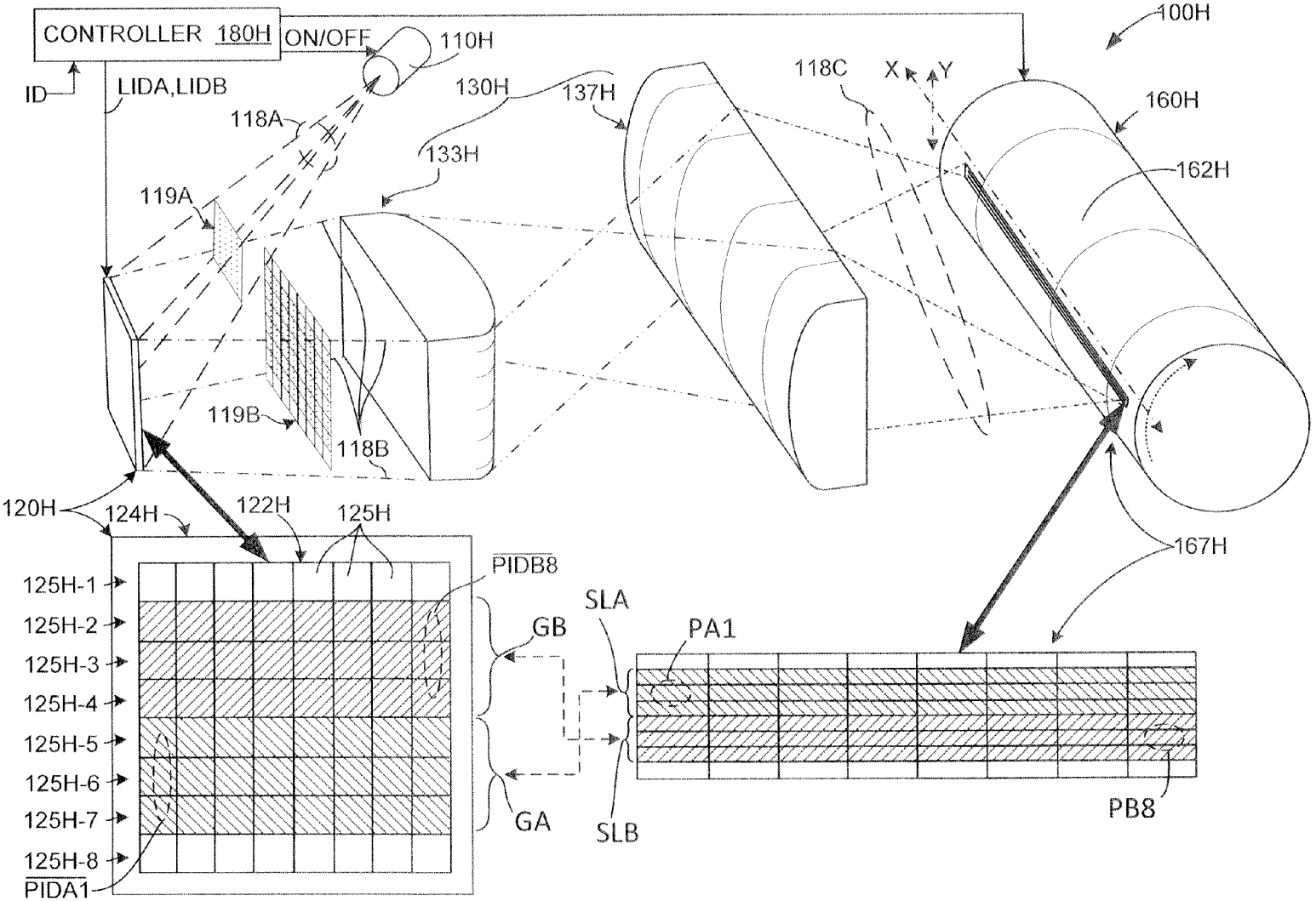
FIG. 9 is a perspective view showing another imaging system utilizing the DMD-type spatial light modulator in the folded arrangement according to another specific embodiment of the present invention.

FIG. 9 is a perspective view showing another imaging system 100H utilizing a DMD-type spatial light modulator 120H in the folded arrangement of FIG. 8 according to another specific embodiment of the present invention. Imaging system 100H also includes a controller 180H that transmits "ON/OFF" control signals to a laser light source 110H, transmits scan line image data portions LINA and LINB to DMD-type spatial light modulator 120H, and transmits an optional position control signal P to a drum cylinder 160H. Similar to the previous embodiment, spatial light modulator 120H includes sixty-four light modulating elements 125H disposed in an eight-by-eight array 122H on a substrate 124H, where light modulating elements comprise the MEMS mirror mechanisms described above with reference to FIGS. 5-7. In addition, similar to the simplified embodiment of FIG. 8, homogenous light field 119A is directed onto light modulating elements 125H to produce a modulated light field 119B that is imaged and concentrated by a cross-process optical subsystem 133H and a process-direction optical subsystem 137H of an anamorphic optical system 130H onto an outer (imaging) surface 162H of a drum cylinder 160H.

Imaging system 100H differs from the previous embodiments in that anamorphic optical system 130H inverts modulated light field 119B in both the process and cross-process directions such that the position and left-to-right order of the two scan line image portions generated on drum cylinder 160H are effectively "flipped" in both the process an cross-process directions. The diagram at the lower left portion of FIG. 9 shows a front view of DMD-type spatial light modulator 120H, and the diagram at the lower right portion of FIG. 9 shows a front view of elongated imaging region 167. The lower left diagram shows that modulating element rows 125H-5 to 125H-7 form a first modulating element group GA for implementing scan line image data portions LINA, and light modulating element rows 125H-2 to 125H-4 form a second modulating element group GB for implementing scan line image data portions LINB (rows 125H-1 and 125H-8 are held in reserve in this embodiment). Note that modulating element groups GA and GB are written into spatial light modulator 120H in an "upside-down and backward" manner such that the leftmost pixel image data PIDA1 of scan line image data portions LINA is written in an inverted (upside-down) manner in the left portion of modulating element group GA (i.e., the lower left portion of array 122H when viewed from the front), and the rightmost pixel image data PID8 of scan line image data portions LINB is written in an inverted (upside-down) manner in the right portion of modulating element group GB (i.e., the upper right portion of array 122H when viewed from the front). As indicated by the double-dot-dash lines in FIG. 9, cross-process optical subsystem 133H inverts modulated light field 119A such that the light modulating elements configured by pixel image data PIDA1 generate pixel image portion PA1 on the right side of elongated imaging region 167H, and the light modulating elements configured by pixel image data PIDB8 generate pixel image portion PB8 on the left side of elongated imaging region 167H. In addition, as indicated by the double-dash-dot lines in FIG. 9, process optical subsystem 137H inverts modulated light field 119A such that (non-inverted) pixel image portion PA1 appears in the upper portion of elongated imaging region 167H, and such that (non-inverted) pixel image portion PB8 appears in the lower portion of elongated imaging region 167H.

FIGS. 10(A), 10(B), 10(C), 10(D), 10(E) and 10(F) are simplified side views showing the imaging system 100H of FIG. 9 during an exemplary imaging operation. Note that the simplified side views ignore inversion in the process-direction, and as such anamorphic optical system 130H is depicted by a single cross-process lens.

Figure 10A:
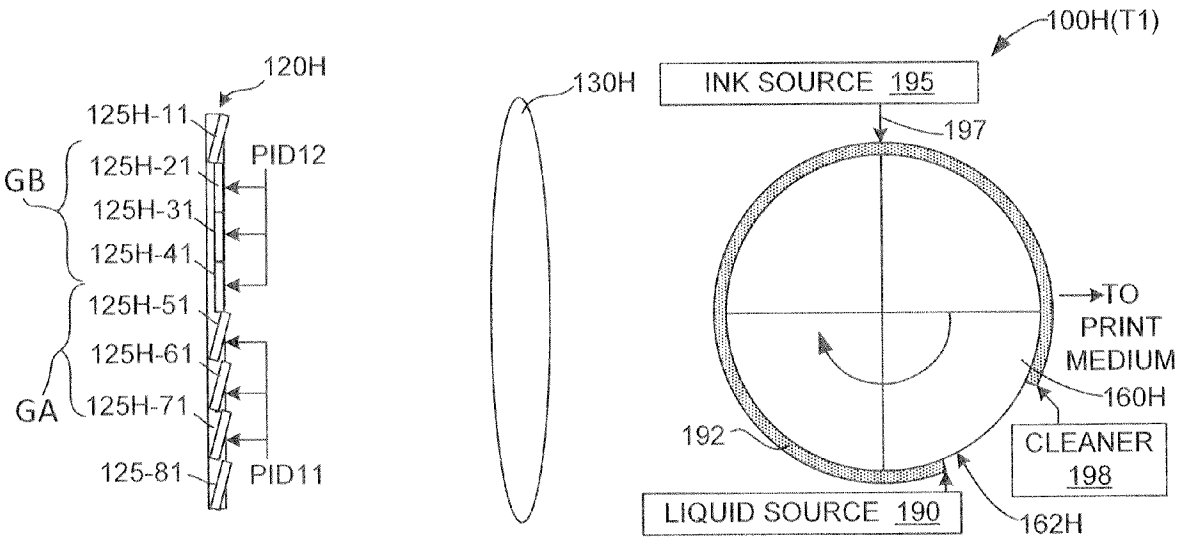
FIGS. 10(A), 10(B), 10(C), 10(D), 10(E) and 10(F) are simplified side views showing the imaging system of FIG. 9 during an imaging operation according to another embodiment of the present invention.

FIG. 10(A) illustrates imaging system 100H(T1) (i.e., imaging system 100H during a first time period T1 of the imaging operation) when homogenous light source 110A is deactivated (turned off) in response to an "off" command, and modulating element groups GA& GB of spatial light modulator 120H are respectively configured in accordance with first and second scan line image data groups in the manner described above with reference to FIG. 9. In particular, FIG. 10(A) depicts the configuration of modulating elements 125H-51 to 125H-71 using a pixel image data portion PID11 of the first scan line image data group, and the configuration of modulating elements 125H-21 to 125H-41 using pixel image data portion PID21 of the second scan line image data group. At this point imaging surface 162H is positioned in the cross-process direction at an arbitrarily selected position determined by a first rotational position of drum roller 160H.

Referring to the right side of FIG. 10(A), to implement an image transfer operation, imaging system 100H further includes a liquid source 190 that applies a fountain solution 192 onto imaging surface 162H at a point upstream of the imaging region, an ink source 195 that applies an ink material 197 at a point downstream of imaging region. In addition, a transfer mechanism (not shown) is provided for transferring the ink material 197 to a target print medium, and a cleaning mechanism 198 provided for preparing imaging surface 162H for the next exposure cycle. The image transfer operation is further described with reference to FIGS. 10(E) and 10 below.

Figure 10B:
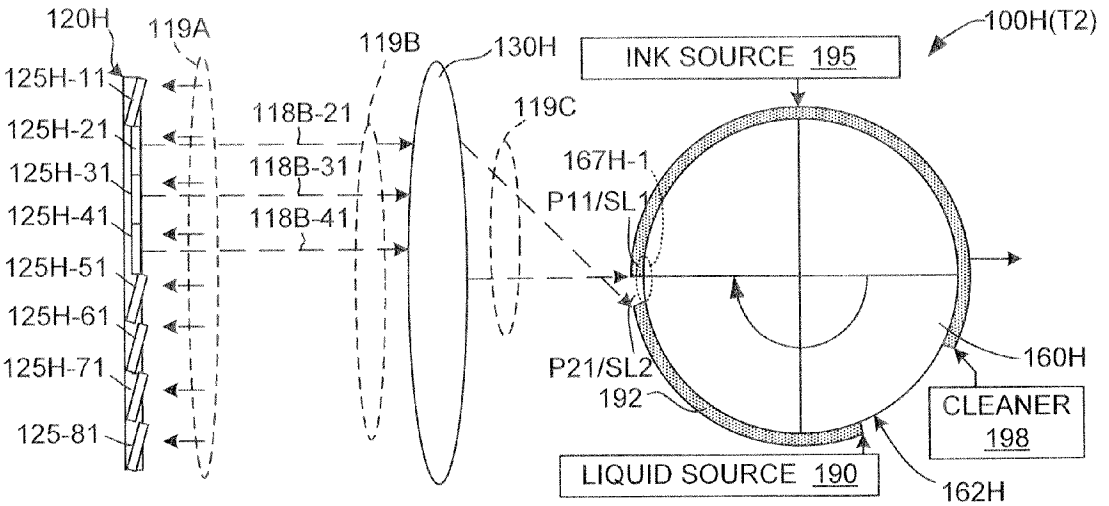

FIG. 10(B) illustrates imaging system 100H(T2) during which homogenous light source 110A is activated (turned on), whereby homogenous light field 119A is directed onto spatial light modulator 120*h*. Because of the configured state of MEMs mirror mechanisms (light modulating elements) 125H-21 to 125H-71, modulated light portions 118B-21, 118B-31 and 118B-41 are reflected from MEMs mirror mechanisms 125H-21 to 125H-41 through anamorphic optical system 130H, but homogeneous light portions are redirected away from anamorphic optical system 130H by MEMs mirror mechanisms 125H-51 to 125H-71 (and "reserve" mirror mechanisms 125H-11 and 125H-81). Modulated light portions 118B-21 to 118B-41 form modulated light field 119B that is imaged and concentrated by anamorphic optical system 130*k*, thereby generating concentrated modulated light field 119C that produces pixel image regions P11 and P21, which are part of a first pair of scan line images SL1 and SL2 formed in a first elongated imaging region 167H-1 on imaging surface 162H. In particular, the concentrated light associated formed by modulated light portions 118B-21, 118B-31 and 118B-41 removes (evaporates) fountain solution 192 from the lower portion of first elongated imaging region 167H-1 (i.e., such that a corresponding portion of imaging surface 162*k* at pixel image region P21 is exposed), but the lack of concentrated light associated with pixel image region P11 allows fountain solution 192 to remain on the upper portion of first elongated imaging region 167H-1. Note that the position of first elongated imaging region 167-1 on imaging surface 162H is determined by the rotational position of drum cylinder 160H at time T2, which has changed by an incremental radial distance between times T1 and T2.

Figure 10C:
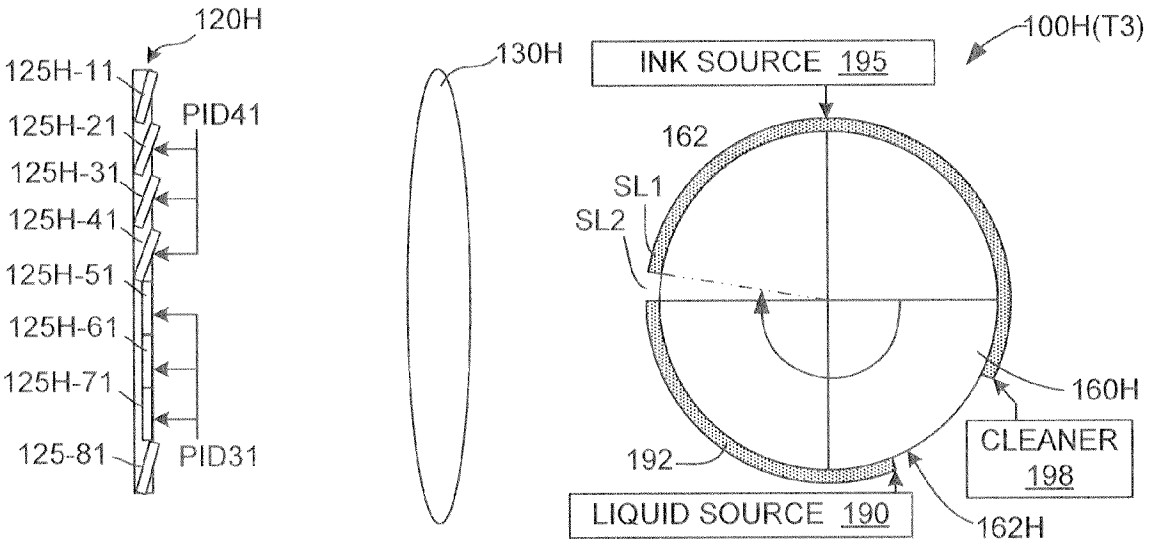

FIG. 10(C) illustrates imaging system 100H(T3) during next sequential (third) time period of the imaging operation after homogenous light source 110*k* (FIG. 9) is again deactivated and MEMs mirror mechanisms 125H-21 to 125H-71 of spatial light modulator 120H are reconfigured in accordance with a second pair of scan line image data groups including pixel image data portions PID31 and PID41. At time T3 the position of first elongated imaging region 167H-1 is rotated upward in accordance with the rotational position of drum cylinder 160H such that it is partially out of the imaging region defined by anamorphic optical system 130H.

Figure 10D:
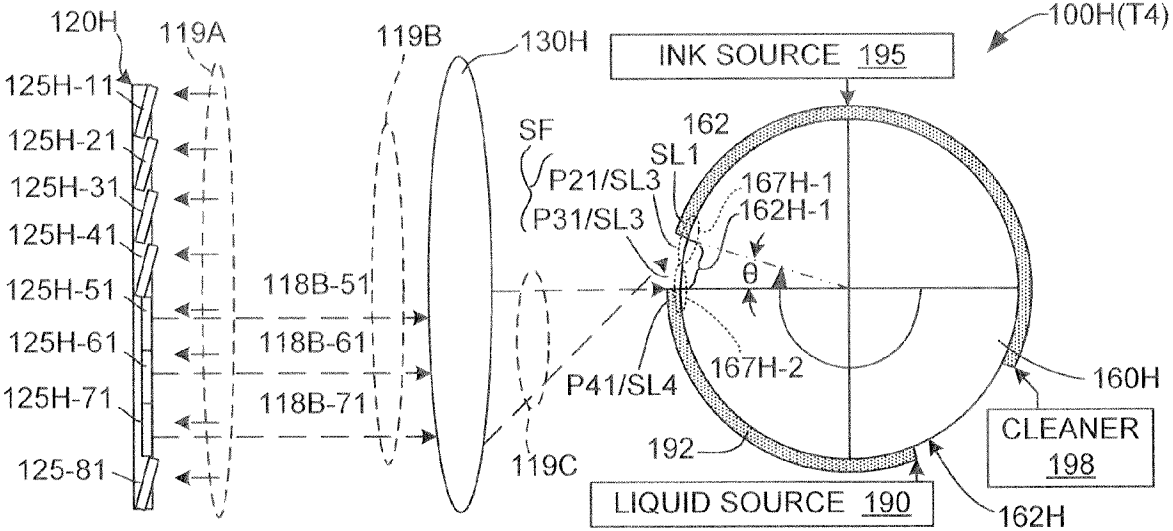

FIG. 10(D) illustrates imaging system 100A(T4) during which homogenous light field 119A is again directed onto spatial light modulator 120H. Because MEMs mirror mechanisms 125H-51 to 125H-71 are on and MEMs mirror mechanisms 125H-21 to 125H-41 are "off" at time 14, modulated light portions 18B-21 to 118B-21 are passed from spatial light modulator 120 to anamorphic optical system 130H. Under these conditions, concentrated light field 119C forms evaporates foundation solution 192 in pixel image region P31 of a third scan line image SL3 in the upper portion of a second elongated imaging region 167H-2, but pixel image region P41 of a scan line image SL4 in the lower portion of second elongated imaging region 167H-2 remains "wet". The location of second elongated imaging region 167H-2 is determined by the rotational position of drum cylinder 160H imaging surface 162 in the cross-process direction at time T4, and in the present embodiment the position of second elongated imaging region 167H-2 is determined by rotating drum cylinder 160H through an angle selected such that lower edge of first elongated imaging region 167H-1 abuts an upper edge of second elongated imaging region 167H-2. That is, imaging surface 162H is moved in the cross-process direction a distance equal to the height of first elongated imaging region 167H-1 between times T2 and 14. As such, a "dry" surface feature SF is formed on a surface region 162H-1 of imaging surface 162H by pixel image regions P21 and P31.

Figure 10E:
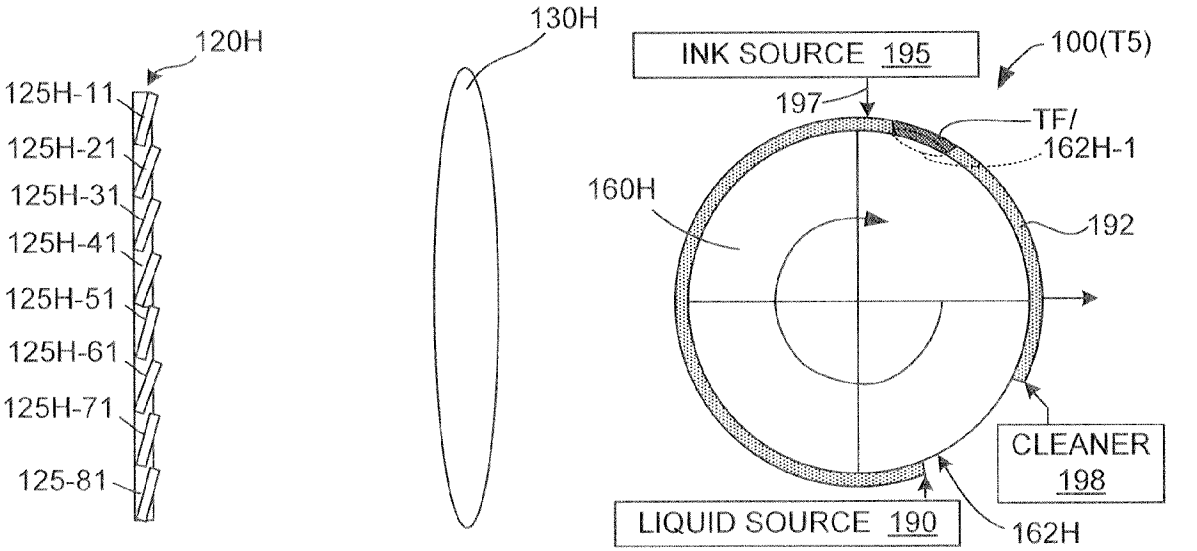
Figure 10F:
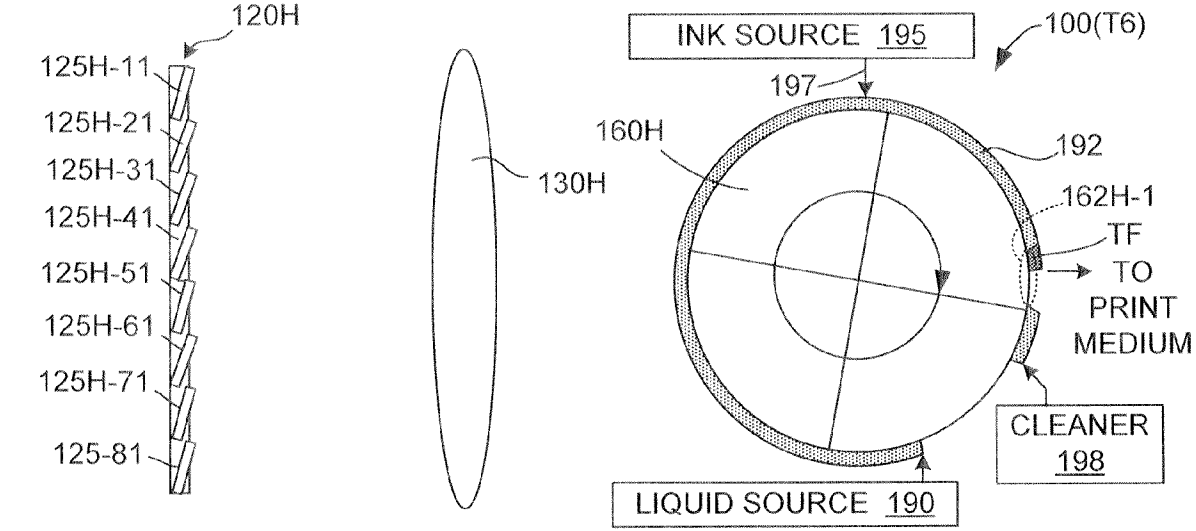

FIGS. 10(E) and 10(F) show imaging system 100H at times subsequent to time T4, where spatial light modulator 120H is deactivated in order to how surface feature SF (see FIG. 10(D)) is subsequently utilized in accordance with the image transfer operation of imaging system 100H. Referring to FIG. 10(E), at a time T5 drum cylinder 160H has rotated such that surface region 162H-1 has passed under ink source 195. Due to the removal of fountain solution depicted in FIG. 10(E), ink material 197 is disposed on exposed surface region 162H-1 form an ink feature TF. As indicated in FIG. 10(F), as ink feature TF passes the transfer point at a subsequent T6, the adhesion between the ink material and surface region 162H-1 causes transfer to the print medium, resulting in a "dot" in the ink printed on the print medium. Surface region 162H-1 is then rotated under cleaning mechanism 198, which removes any residual ink and fountain solution material to prepare surface region 162H-1 for a subsequent exposure/print cycle. According to the above-described image transfer operation, only ink material disposed on imaging surface 162H is transferred to the print medium. Thus, variable data from fountain solution removal is transferred, instead of constant data from a plate as in conventional systems. For this process to work using a rastered light source (i.e., a light source that is rastered back and forth across the scan line), a single very high power light (e.g., laser) source would be required sufficiently remove toe fountain solution in real time. A benefit of the imaging operation of the present invention is that, because liquid from an ink donor roller is removed from the entire scan line simultaneously, an offset press configuration is provided at high speed using multiple relatively low power light sources.

Although the invention is described above with reference to the configuration of contiguous modulating element groups (e.g., groups GA and GE of FIG. 9) in order to form two or more contiguous scan line images (e.g., scan line images SLA and SLB shown in FIG. 9), in other embodiments the light modulating elements utilized to generate each scan line image are disposed in separated modulating element groups, whereby the two-dimensional image is formed by generating two interlaced scan line images during each imaging phase. Examples of interlaced multiple-line imaging operations producing such interlaced scan line images are described below with reference to FIGS. 11-12.

Figure 12A:
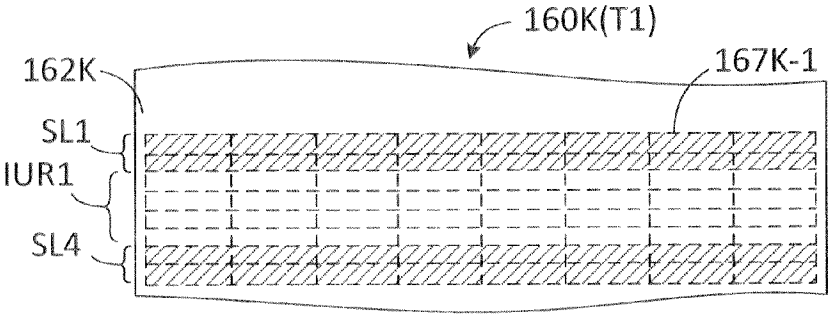
FIGS. 12(A), 12(B) and 12(C) are simplified front views showing an imaging surface during successive imaging operation periods utilizing the interlaced multiple-line imaging operation performed using the spatial light modulator configuration of FIG. 11.
Figure 12B:
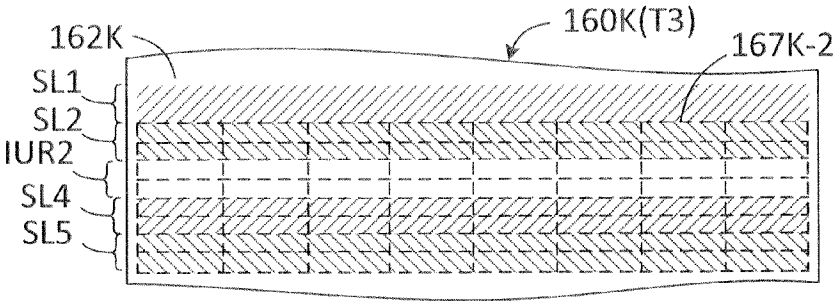
Figure 12C:
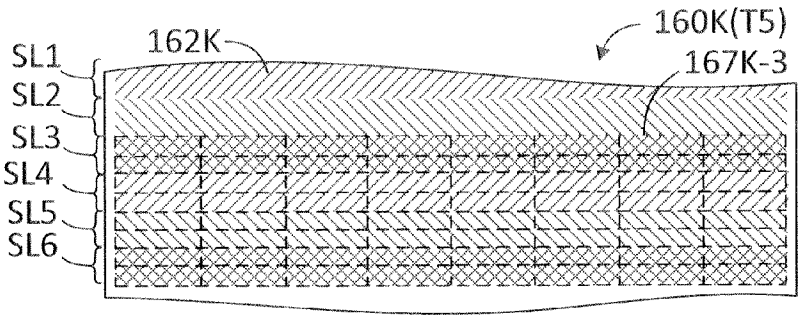
Figure 11:
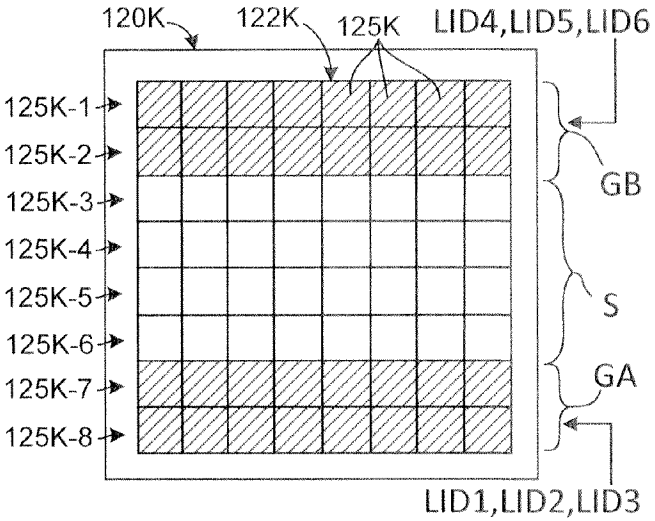
FIG. 11 is a simplified front view showing a DMD-type spatial light modulator configured to implement simplified interlaced multiple-line imaging operation according to yet another embodiment of the present invention.

FIG. 11 is a simplified front view showing a DMD-type spatial light modulator 120K including an eight-by-eight array 122K of MEMs mirror mechanisms (light modulating elements) 125K that are configured to implement a simplified interlaced multiple-line imaging operation according to a second interlaced multiple-line imaging operation, and FIGS. 12(A)-12(C) are simplified front views showing an imaging surface 162K of a drum cylinder 160K during successive imaging phases of the interlaced multiple-line imaging operation.

Referring FIG. 11, during each imaging phase, DMD-type spatial light modulator 120K is configured such that modulating element rows 125K-7 and 125K-8 form a first modulating element group GA for implementing a first scan line image data portion, and light modulating element rows 125K-1 and 125K-2 form a second modulating element group GB for implementing a second scan line image data portion. Modulating element groups GA and GB are separated by an idle modulating element group S comprising modulating element rows 125K-3 to 125K-6.

FIGS. 12(A) to 12(C) show scan line images generated on imaging surface 162K during three successive imaging phases. FIG. 12(A) shows drum roller 160K(T1) during a first imaging phase in which scan line image portions SL1 and SL4 are generated in a first elongated imaging region 167K-1 in response to scan line image data portions LID1 and LID4, where a first interlaced unprocessed region IUR1 is generated between scan line image portions SL1 and SL4. FIG. 12(B) shows drum roller 160K(T2) during a second imaging phase, after imaging surface 162K has moved in a cross-process direction by a distance equal to the height of scan line image portion SL1, during which scan line image portions SL2 and SL5 are generated in a second elongated imaging region 167K-2 in response to scan line image data portions LID2 and LID5, where a second interlaced unprocessed region IUR2 is generated between scan line image portions SL2 and SL4. FIG. 12(C) shows drum roller 160K(T3) during a third imaging phase, after imaging surface 162K has moved in a cross-process direction by a second distance equal to the height of scan line image portion SL2, during which scan line image portions SL3 and SL6 are generated in a third elongated imaging region 167K-3 in response to scan line image data portions LID1 and LID6, whereby linear scan regions SL1 to SL6 are generated without any intervening spaces.

Although the present invention has been described with respect to certain specific embodiments, it will be clear to those skilled in the art that the inventive features of the present invention are applicable to other embodiments as well, all of which are intended to fall within the scope of the present invention. For example, although the present invention is illustrated as having on paths that are near (see FIG. 1) or with having one fold (see FIG. 8), other arrangements may be contemplated by those skilled in the art that include folding along any number of arbitrary light paths. Finally, the methods described above for generating a high energy scan line image may be achieved using devices other than those described herein.

The invention claimed is:

1. A method for simultaneously generating two or more substantially one-dimensional scan line image portions of a two-dimensional image on an imaging surface, said two-dimensional image being stored in an image data file including a plurality of scan line image data groups, each scan line image data group including a plurality of image pixel data portions representing an associated one-dimensional scan line image portion of said two-dimensional image, the method comprising:

configuring a spatial light modulator including a plurality of light modulating elements arranged in a plurality of rows and a plurality of columns in accordance with at least two scan line image data groups of said plurality of scan line image data groups, wherein said configuring includes:

adjusting a first modulating element group of said plurality of modulating elements that is disposed in a first plurality of said rows in accordance with a first scan line image data group of said plurality of scan line image data groups such that two or more modulating elements disposed in each column of said first modulating element group are adjusted in accordance with an associated image pixel data portion of said first scan line image data group, and adjusting a second modulating element group including modulating elements disposed in a second plurality of said rows in accordance with a second scan line image data group of said plurality of scan line image data groups such that two or more modulating elements disposed in each column of said second modulating element group are adjusted in accordance with an associated image pixel data portion of said second scan line image data group; and utilizing the configured spatial light modulator to generate first and second substantially one-dimensional scan line images on said imaging surface by directing homogenous light onto the plurality of light modulating elements such that the configured first and second modulating element groups generate a modulated light field that is transmitted through an anamorphic optical system onto said imaging surface, wherein the anamorphic optical system is formed and positioned such that said modulated light field is anamorphically imaged and concentrated to form said first and second substantially one-dimensional scan line images on an elongated imaging region of said imaging surface.

2. The method according to claim 1, wherein directing said homogenous light onto the plurality of light modulating elements comprises causing a laser light source to transmit one or more light beams having a first flux density through a homogenizer such that the homogenous light is emitted from the homogenizer and directed onto the plurality of light modulating elements.

3. The method of claim 1, wherein configuring said spatial light modulator includes individually adjusting, in response to said associated image pixel data portion, each modulating element of said plurality of modulating elements in the first and second modulating element groups into one of a first modulated state and a second modulated state, wherein said plurality of light modulating elements are arranged such that when said each modulating element is in said first modulated state, said each modulating element modulates an associated received homogenous light portion of said homogenous light such that an associated modulated light portion is directed in a corresponding predetermined direction, and when said each modulating element is in said second modulated state, said each modulating element modulates the associated received homogenous light portion such that the associated modulated light portion is prevented from passing along said corresponding predetermined direction.

4. The method according to claim 1, wherein directing homogenous light further comprises:

projecting and magnifying said modulated light field in a cross-process direction using first and second focusing lens, and concentrating said modulated light field in a direction parallel to a process direction using a third focusing lens.

5. The method according to claim 1, wherein configuring the spatial light modulator includes adjusting the first and second modulating element groups during a first time period, and wherein directing said homogenous light onto the plurality of light modulating elements comprises deactivating a homogenous light source during the first time period, and activating the homogenous light source during a second time period such that said homogenous light is directed onto the plurality of light modulating elements during said second time period.

6. The method according to claim 5, further comprising, after the second time period, deactivating the homogenous light source;

while the homogenous light source is deactivated, moving the imaging surface in a cross-process direction and simultaneously reconfiguring the spatial light modulator in accordance with both a third scan line image data group and a fourth scan line image data group of said plurality of scan line image data groups; and re-activating the homogenous light source.

7. The method according to claim 6, wherein the first plurality of said rows forming the first modulating element group are contiguous with the second plurality of rows forming the second modulating group, and wherein moving the imaging surface in a cross-process direction comprises moving the imaging surface a distance equal to a total height of the first and second scan lines measured in the cross-scan direction.

8. The method according to claim 1, wherein configuring said spatial light modulator comprises configuring one of a digital micromirror device, an electro-optic diffractive modulator array, and an array of thermo-optic absorber elements.

9. The method according to claim 1, wherein configuring said spatial light modulator comprises configuring a plurality of microelectromechanical (MEMs) mirror mechanisms disposed on a substrate by individually controlling the MEMs mirror mechanisms such that a mirror of each said MEM mirror mechanism is moved between a first tilted position relative to the substrate, and a second tilted position relative to the substrate in accordance with said associated image pixel data portion.

10. The method according to claim 9, wherein configuring said spatial light modulator further comprises positioning the spatial light modulator such that, when the mirror of each said MEMs mirror mechanism is in the first tilted position, said mirror reflects an associated portion homogenous light portion of said homogenous light such that said reflected light portion is directed to an anamorphic optical system, and when said mirror of each said MEMs mirror mechanism is in the second tilted position, said mirror reflects said associated received homogenous light portion such that said reflected light portion is directed away from the anamorphic optical system.

11. The method according to claim 9, wherein configuring the spatial light modulator includes adjusting the first and second modulating element groups during a first time period, and wherein directing said homogenous light onto the plurality of MEMs mirror mechanisms comprises deactivating a light source during the first time period, and activating the light source during a second time period such that said homogenous light is directed onto the plurality of MEMs mirror mechanisms during said second time period.

12. The method according to claim 11, further comprising, after the second time period, deactivating the light source;

while the light source is deactivated, moving the imaging surface in a cross-process direction and simultaneously reconfiguring the plurality of MEMs mirror mechanisms in accordance with both a third scan line image data group and a fourth scan line image data group of said plurality of scan line image data groups; and re-activating the light source such that third and fourth substantially one-dimensional scan line images are generated on an elongated imaging region of said imaging surface.

13. The method according to claim 12, wherein the first plurality of said rows forming the first modulating element group are contiguous with the second plurality of rows forming the second modulating group, and wherein moving the imaging surface in a cross-process direction comprises moving the imaging surface a distance equal to a total width of the first and second scan lines measured in the cross-process direction.

14. The method according to claim 12, wherein the first plurality of said rows forming the first modulating element group are separated by an intervening plurality of rows from the second plurality of rows forming the second modulating group, and wherein moving the imaging surface in a cross-process direction comprises moving the imaging surface a distance equal to a width of the first scan line measured in the cross-process direction.

15. A method for simultaneously generating two or more substantially one-dimensional scan line image portions of a two-dimensional image on an imaging surface, said two-dimensional image being stored in an image data file including a plurality of scan line image data groups, each scan line image data group including a plurality of image pixel data portions representing an associated one-dimensional scan line image portion of said two-dimensional image:

during a first time period, configuring a spatial light modulator including a plurality of light modulating elements arranged in a plurality of rows and a plurality of columns in accordance with at least two scan line image data groups of said plurality of scan line image data groups, wherein said configuring includes:

adjusting a first modulating element group of said plurality of modulating elements that is disposed in a first plurality of said rows in accordance with a first scan line image data group of said plurality of scan line image data groups such that two or more modulating elements disposed in each column of said first modulating element group are adjusted in accordance with an associated image pixel data portion of said first scan line image data group, and adjusting a second modulating element group including modulating elements disposed in a second plurality of said rows in accordance with a second scan line image data group of said plurality of scan line image data groups such that two or more modulating elements disposed in each column of said second modulating element group are adjusted in accordance with an associated image pixel data portion of said second scan line image data group; and during a second time period, directing homogenous light onto the plurality of light modulating elements such that the configured first and second modulating element groups generate a modulated light field that is transmitted through an anamorphic optical system such that said modulated light field is anamorphically imaged and concentrated to form first and second substantially one-dimensional scan line images on said imaging surface.

16. The method according to claim 15, wherein directing said homogenous light onto the plurality of light modulating elements comprises activating a laser light source during the second time period to generate one or more light beams having a first flux density such that said one or more light beams are directed through a homogenizer to generate the homogenous light directed onto the plurality of light modulating elements, and de-activating the laser light source during the first time period.

17. The method according to claim 16, further comprising:

during a third time period, deactivating the homogenous light source, and then reconfiguring the spatial light modulator in accordance with both a third scan line image data group and a fourth scan line image data group of said plurality of scan line image data groups while moving the imaging surface in a cross-process direction; and during a fourth time period, re-activating the homogenous light source such that the reconfigured first and second modulating element groups generate a second modulated light field that is transmitted through the anamorphic optical system to form third and fourth substantially one-dimensional scan line images on said imaging surface.

18. The method according to claim 17, wherein the first plurality of said rows forming the first modulating element group are contiguous with the second plurality of rows forming the second modulating group, and wherein moving the imaging surface in a cross-process direction comprises moving the imaging surface a distance equal to a total width of the first and second scan lines measured in the cross-scan direction.

19. The method according to claim 17, further comprising, deactivating the light source during a third time period following the second time period;

while the light source is deactivated, moving the imaging surface in a cross-process direction and simultaneously reconfiguring the plurality of MEMs mirror mechanisms in accordance with both a third scan line image data group and a fourth scan line image data group of said plurality of scan line image data groups; and re-activating the light source.

* * * * *